US006540338B2

(12) United States Patent
Takahashi et al.

(10) Patent No.: US 6,540,338 B2
(45) Date of Patent: Apr. 1, 2003

(54) METHOD OF DRIVING INK JET RECORDING HEAD AND INK JET RECORDING APPARATUS INCORPORATING THE SAME

(75) Inventors: Tomoaki Takahashi, Nagano (JP); Hirofumi Teramae, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/970,926

(22) Filed: Oct. 5, 2001

(65) Prior Publication Data

US 2002/0057303 A1 May 16, 2002

(30) Foreign Application Priority Data

Oct. 6, 2000 (JP) ..... 2000-308049
Oct. 6, 2000 (JP) ..... 2000-308050

(51) Int. Cl.[7] ..... B41J 25/308; B41J 2/05; B41J 2/045

(52) U.S. Cl. ..... 347/68; 347/9; 347/11; 347/57

(58) Field of Search ..... 347/48, 54, 68, 347/10, 11, 15, 55–57

(56) References Cited

U.S. PATENT DOCUMENTS 4,672,398 A * 6/1987 Kuwabara et al. ..... 347/11
4,686,539 A * 8/1987 Schmidle et al. ..... 347/11
5,049,899 A * 9/1991 Dunand et al. ..... 347/11
5,646,659 A 7/1997 Moriyama et al.
5,821,953 A 10/1998 Nakano et al.

FOREIGN PATENT DOCUMENTS

| | | |
|---|---|---|
| EP | 0 737 586 A1 | 10/1996 |
| EP | 0 810 097 A1 | 12/1997 |
| EP | 1 023 997 A2 | 8/2000 |
| JP | 07-285222 | 10/1995 |

* cited by examiner

*Primary Examiner*—Raquel Yvette Gordon
*Assistant Examiner*—An H. Do
(74) *Attorney, Agent, or Firm*—Sughrue Mion, PLLC

(57) ABSTRACT

A recording head is provided with a pressure chamber communicated with a nozzle orifice. A pressure generating element generates pressure fluctuation in ink contained in the pressure chamber. A drive signal generator generates a drive signal for driving the pressure generating element such that a main ink droplet and a satellite ink droplet accompanied with the main ink droplet are ejected to form an ink dot on a recording medium. The main ink droplet has a first volume, and the satellite ink droplet has a second volume which is larger than the first volume. Alternatively, the main ink droplet is ejected with a first speed, and the satellite ink droplet is ejected a second speed which is faster than the first speed.

24 Claims, 10 Drawing Sheets

METHOD OF DRIVING INK JET RECORDING HEAD AND INK JET RECORDING APPARATUS INCORPORATING THE SAME

BACKGROUND OF THE INVENTION

The present invention generally relates to a driving method for an ink jet recording head enabled to eject an ink droplet, and to an ink jet recording apparatus for recording images and characters on recording paper by using such an ink jet recording head. More particularly, the invention relates to a driving method for an ink jet recording head adapted to eject an extremely small amount of ink in an ink droplet, which can form a microdot, and to an ink jet recording apparatus for recording images and characters on recording paper by using such an ink jet recording head.

Some printers and plotters are well known as typical ink jet recording apparatus (hereunder referred to simply as recording apparatus). In these recording apparatus, the diameter of a dot recorded on recording paper, that is, the resolution of the apparatus is determined according to the quantity of ink of ink droplets ejected from an ink jet recording head. Therefore, the ink quantity of the ejected ink droplets is important. Thus, there has been proposed a recording apparatus having a recording head adapted to eject ink droplets, the respective ones of which have different amounts of ink, from the same nozzle orifice. This recording head has a pressure generating element adapted to cause variation in pressure in ink contained in a pressure chamber. The recording head is caused to eject ink droplets, the respective ones of which have different amounts of ink, by supplying a plurality of kinds of drive pulses, which differ in electric potential change pattern from one another, to the pressure generating element.

Further, a related microdot drive pulse, that is, a drive pulse for ejecting an extremely small amount of ink of an ink droplet has a decompressing component for largely decompressing the pressure chamber, a decompressed state holding component for holding a decompressed state of the pressure chamber, and a compressing component for compressing the pressure chamber so as to eject ink droplets from the nozzle orifice. Supply of the decompressing component and the decompressed state holding component of this microdot drive pulse causes a central portion of the meniscus of ink (that is, a free surface of ink, which is exposed to the nozzle orifice) to protrude in such a manner as to have a columnar shape. Further, supply of the discharging component causes the recording head to eject the columnar portion of the ink as an ink droplet.

When the recording head is driven by such a microdot drive pulse, an ink droplet is divided into a main ink droplet, which is separated from an end portion of an ink column and jetted, and a satellite ink droplet that is jetted in such a way as to accompany the main ink droplet. The jetting speed of this satellite ink droplet is lower than that of the main ink droplet. Moreover, the amount of ink of the satellite ink droplet is less than that of ink of the main ink droplet. For example, when the jetting speed of the main ink droplet is about 7 m/s, that of the satellite ink droplet is approximately 4 m/s. Furthermore, the amount of ink of the satellite ink droplet is two thirds of that of the main ink droplet.

In recent years, it is demanded a recording apparatus capable of recording image with further improved quality. It is necessary for meeting this demand to more reduce an ink amount of each ink droplet. However, when an ink droplet is ejected in response to a related microdot drive pulse, the amount of ink of the satellite ink droplet is extremely small. For instance, when about 1.5 pL of ink of an ink droplet is ejected, the amount of ink of the satellite ink droplet is about 0.5 pL.

Thus, the satellite ink droplet is largely affected by the viscous resistance of air. Consequently, the jetting speed of the satellite ink droplet is largely reduced until the satellite ink droplet impacts on recording paper. On the other hand, generally, the amount of ink of the main ink droplet is more than that of ink of the satellite ink droplet. Thus, the degree of reduction in the speed of the main ink droplet is lower than that of reduction in the speed of the satellite ink droplet. Consequently, when the droplet impacts on the recording paper, the difference in the jetting speed between the main ink droplet and the satellite ink droplet increases still more. Further, the ejection of the ink droplets is performed by simultaneously moving the recording head. This raises the problems that the impact positions of the main ink droplet and the satellite ink droplet deviate from each other owing to the difference in the jetting speeds, and that the image quality is degraded contrary to the demand.

Moreover, there is a probability that the satellite ink droplets cannot reach the recording paper due to the air resistance. In such a case, the satellite ink droplets float as ink mists. When such ink mists adhere to a casing and a nozzle plate of the recording head, the deflection of flight path of the ink droplet and the contamination of the inside of the apparatus are caused, so that the reliability of the apparatus is degraded.

SUMMARY OF THE INVENTION

Accordingly, a first object of the invention is to provide a driving method for an ink jet recording head enabled to increase the jetting speed of an ink droplet even when an ink amount of the ink droplet is extremely small, and to provide an ink jet recording apparatus incorporating such a recording head.

A second object of the invention is to make the impact positions of a main ink droplet and a satellite ink droplet coincide with each other, while preventing the satellite ink droplets from becoming ink mists, thereby to improve the image quality.

In order to achieve the above objects, according to the present invention, there is provided a method of driving an ink jet recording head provided with a pressure chamber communicated with a nozzle orifice from which a main ink droplet and a satellite ink droplet accompanied with the main ink droplet are ejected to form an ink dot on a recording medium, comprising the steps of:

generating pressure fluctuation in the pressure chamber;

ejecting ink contained therein from the nozzle orifice as the main ink droplet having a first volume, due to the pressure fluctuation; and ejecting ink contained therein from the nozzle orifice as the satellite ink droplet having a second volume which is larger than the first volume, due to the pressure fluctuation.

In this configuration, the satellite ink droplet becomes more resistible to the influence of the viscous resistance of air, as compared with the main ink droplet. Moreover, the rate of reduction in the ratio of the speed to the flight distance of the satellite ink droplet becomes smaller than that corresponding to the main ink droplet. This enables reduction in the difference in the speed at the impact position between the main ink droplet and the satellite ink droplet.

Thus, the deviation of the impact position of the satellite ink droplet from that of the main ink droplet is decreased. Consequently, even when an extremely small ink droplet is ejected, the impact position of the main ink droplet is made to coincide with that of the satellite ink droplet, so that the image quality of the recorded image is improved. Furthermore, the amount of ink of the satellite ink droplet, the jetting speed of which is liable to be low, is more than that of the main ink droplet. Thus, the ink droplets are enabled to reliably land onto the recording medium. Consequently, the ink droplets are prevented from becoming ink mists.

There may be accompanied plural satellite ink droplets. In this case, the amount (second volume) of at last one of these satellite ink droplets is more than the amount of ink of a main ink droplet.

Preferably, the pressure fluctuation generating step includes the steps of:

decompressing the pressure chamber such that a central portion of a meniscus of ink in the nozzle orifice is locally pulled toward the pressure chamber; and compressing the pressure chamber when the pulled meniscus reactionally moves in a direction in which the ink droplets are ejected.

Here, it is preferable that the decompressing step includes the steps of:

decompressing the pressure chamber with a first decompressing force so as to pull the meniscus toward the pressure chamber while keeping a shape of the meniscus in a stationary state thereof;

decompressing the pressure chamber with a second decompressing force which is greater than the first decompressing force, so as to locally pull the central portion of the meniscus; and holding the decompressed state of the pressure chamber until the pulled meniscus reactionally moves in the direction in which the ink droplets are ejected.

Here, the expression "stationary state" designates a state in which extremely small pressure fluctuation occurs in the pressure chamber, and in which the meniscus is placed in the vicinity of a nozzle formation face, that is, a state in which ink is filled in the nozzle orifice. Further, the expression "keeping a shape of meniscus" means that a slight change in curvature is permitted.

In this configuration, since the meniscus is pulled toward the pressure chamber while keeping the shape of the meniscus in the stationary state thereof, the inertance at the nozzle orifice side is lowered. Thus, the response of the meniscus to the pressure fluctuation of ink in the pressure chamber is enhanced so that the central portion of the meniscus can be locally pulled by rapidly decompressing the inside of the pressure chamber. Moreover, since the pressure chamber is compressed in synchronization with timing with which the pulled central portion of the meniscus moves in the ejecting direction as a reaction, the pressure of ink from the pressure chamber is applied to the central portion of the meniscus during the reaction, so that the central portion of the meniscus, which becomes an ink droplet, is strongly pushed out. Consequently, the jetting speed of the ink droplet is increased. Therefore, the ink droplet obtains a sufficient jetting speed even when the amount of ink of the droplet is extremely small. Thus, the ink droplet is impacted onto a desired place. Consequently, the image quality of the recorded image is further improved.

According to the present invention, there is also provided a method of driving an ink jet recording head provided with a pressure chamber communicated with a nozzle orifice from which a main ink droplet and a satellite ink droplet accompanied with the main ink droplet are ejected to form an ink dot on a recording medium, comprising the steps of:

generating pressure fluctuation in the pressure chamber;

ejecting ink contained therein from the nozzle orifice as the main ink droplet with a first speed, due to the pressure fluctuation; and ejecting ink contained therein from the nozzle orifice as the satellite ink droplet with a second speed which is faster than the first speed, due to the pressure fluctuation.

In this configuration, the satellite ink droplet ejected after the ejection of the main ink droplet is jetted at a speed that is higher than the speed, at which the main ink droplet ejected before the ejection of the satellite ink droplet is jetted. This can bring the impact position of the main ink droplet on the recording paper close to that of the satellite ink droplet. Consequently, even when an extremely small ink droplet is ejected, the impact positions of a main ink droplet and a satellite ink droplet can be made to coincide with each other thereby to improve the image quality. Furthermore, the jetting speed of the satellite ink droplet, the amount of ink of which is liable to be small, is higher than that of the main ink droplet. Thus, the ink droplets are enabled to reliably land onto the recording paper. Consequently, the ink droplets are prevented from becoming ink mists.

Preferably, the pressure fluctuation generating step includes the steps of:

compressing the pressure chamber with a first compressing force at a timing when the main ink droplet is separated from a meniscus of ink in the nozzle orifice; and compressing the pressure chamber with a second compressing force which is greater than the first compressing force, at a timing when the satellite ink droplet is separated from the meniscus.

Here, it is preferable that the decompressing component includes:

a first decompressing component, which decompress the pressure chamber with a first decompressing force so as to pull the meniscus toward the pressure chamber while keeping a shape of the meniscus in a stationary state thereof; and a second decompressing component, which decompress the pressure chamber with a second decompressing force which is greater than the first decompressing force, so as to locally pull the central portion of the meniscus.

Further, it is preferable that the nozzle orifice has a first part in which a diameter thereof is constant, and a second part in which the diameter is enlarged toward the pressure chamber. The central portion of meniscus pulled by the second decompressing component is placed in the second part of the nozzle orifice.

In this configuration, the inertance at the nozzle orifice side is further lowered. Therefore, the response of the meniscus to the pressure fluctuation of ink contained in the pressure chamber is further enhanced. Consequently, the jetting speed of the ink droplet is easily increased.

Preferably, a termination end of the second decompressing component and an initial end of the compressing component is connected by a first holding component which maintains a potential of the termination end of the second decompressing component.

In this configuration, the meniscus performs free vibration over a time during which the first holding component is supplied. Furthermore, since the first holding component provides timing with which the supply of the compressing component is started. Thus, the timing, with which the central portion of the meniscus is pushed out, is optimized according to the setting of the time period during which the first holding component is supplied.

Preferably, the drive signal includes a damping component which follows the compressing component and compresses the pressure chamber so as to prevent the meniscus after the ink droplet ejection from reactionally moving toward the pressure chamber.

In this configuration, the vibration of the meniscus due to the ink ejection is settled in a short time. Thus, a time interval required for enabling the next ejection of an ink droplet is shortened. Thus, a printing period is shortened. Consequently, the printing speed is increased.

Here, it is preferable that a termination end of the compressing component and an initial end of the damping component is connected by a second holding component which maintains a potential of the termination end of the compressing component.

In this configuration, the timing, with which the supply of the damping component is commenced, is determined according to the time period during which the second holding component is supplied. Thus, the timing, with which the pressure chamber is compressed, is optimized. Consequently, the damping is effectively performed.

According to the present invention, there is also provided an ink jet recording apparatus, comprising:

a recording head, provided with a pressure chamber communicated with a nozzle orifice;

a pressure generating element, which generates pressure fluctuation in ink contained in the pressure chamber; and a drive signal generator, which generates a drive signal for driving the pressure generating element such that a main ink droplet and a satellite ink droplet accompanied with the main ink droplet are ejected to form an ink dot on a recording medium, the main ink droplet having a first volume, and the satellite ink droplet having a second volume which is larger than the first volume.

Preferably, the drive signal includes:

a decompressing component, which decompresses the pressure chamber such that a central portion of a meniscus of ink in the nozzle orifice is locally pulled toward the pressure chamber; and a compressing component, which compresses the pressure chamber when the pulled meniscus reactionally moves in a direction in which the ink droplets are ejected.

According to the present invention, there is also provided an ink jet recording apparatus, comprising:

a recording head, provided with a pressure chamber communicated with a nozzle orifice;

a pressure generating element, which generates pressure fluctuation in ink contained in the pressure chamber; and a drive signal generator, which generates a drive signal for driving the pressure generating element such that a main ink droplet and a satellite ink droplet accompanied with the main ink droplet are ejected to form an ink dot on a recording medium, the main ink droplet ejected with a first speed, and the satellite ink droplet ejected a second speed which is faster than the first speed.

Preferably, the drive signal includes:

a first compressing component, which compresses the pressure chamber with a first compressing force at a timing when the main ink droplet is separated from a meniscus of ink in the nozzle orifice; and a second compressing component, which compresses the pressure chamber with a second compressing force which is greater than the first compressing force, at a timing when the satellite ink droplet is separated from the meniscus.

Here, it is preferable that a potential gradient of the second compressing component is steeper than a potential gradient of the first compressing component.

Preferably, the pressure generating element is an electromechanical transducer.

Here, it is preferable that the electromechanical transducer is a piezoelectric vibrator.

According to the present invention, there is also provided a method of driving an ink jet recording head provided with a pressure chamber communicated with a nozzle orifice from which a main ink droplet and a satellite ink droplet accompanied with the main ink droplet are ejected to form an ink dot on a recording medium, comprising the steps of:

decompressing the pressure chamber while lowering an inertance of ink situated closer to the pressure chamber than an inertance of ink situated closer to the nozzle orifice; and compressing the pressure chamber to eject the main ink droplet and the satellite ink droplet.

Preferably, a shape of the nozzle orifice is determined so as to realize the inertance lowering.

Preferably, an intensity and a duration time period of a decompressing force generated in the decompressing step is determined so as to realize the inertance lowering.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Hereinafter, an embodiment of the invention is described hereinbelow with reference to the accompanying drawings.

Figure 1:
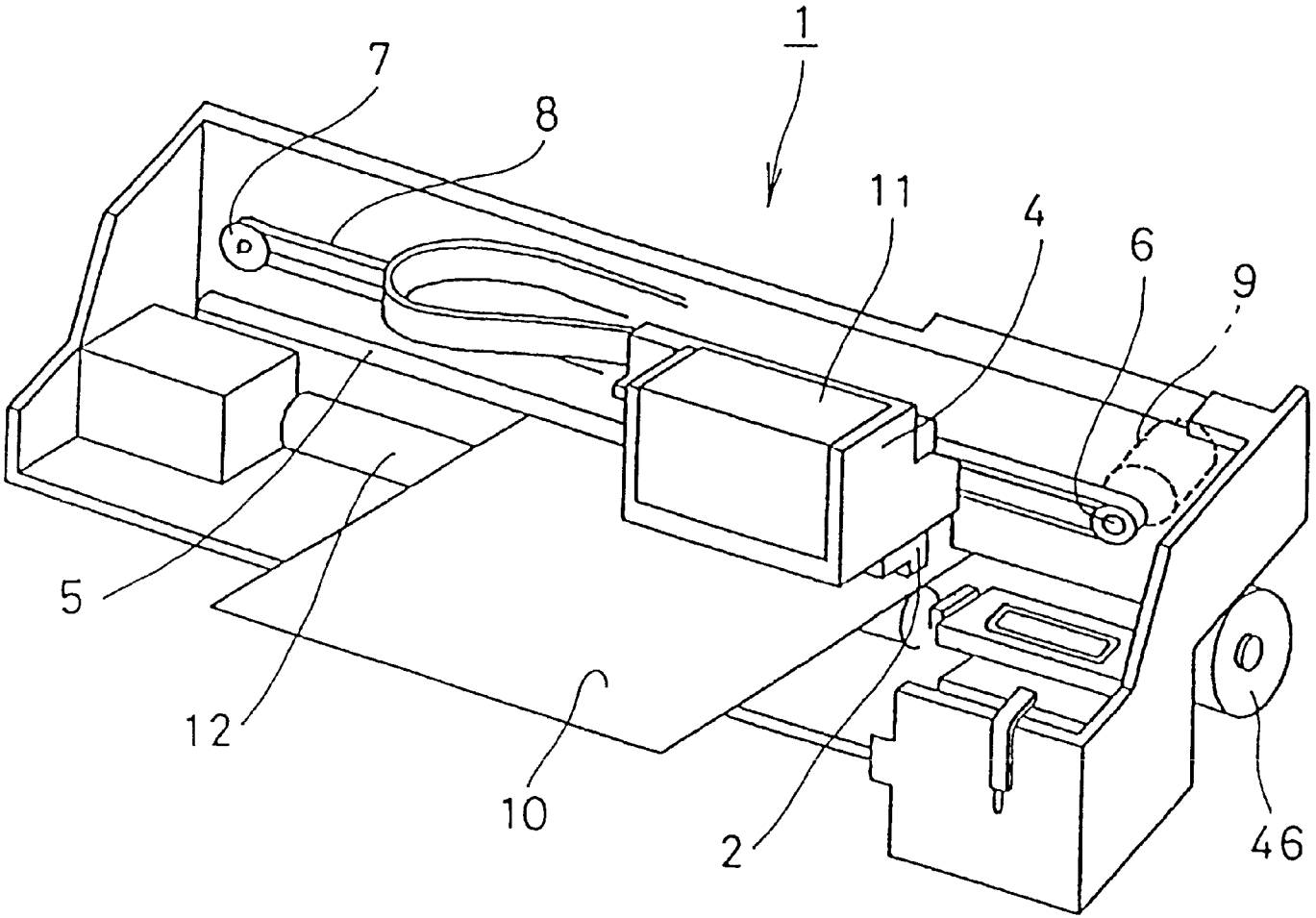
FIG. 1 is a perspective view illustrating an ink jet printer that is an ink jet recording apparatus according to the invention.

As shown in FIG. 1, a carriage 4 is movably mounted on a guide member 5 in an ink jet printer 1 (hereunder referred to as a printer 1) which represents an ink jet recording apparatus. The carriage 4 is connected to a timing belt 8 looped between a driving pulley 4 and a driven pulley 7. The driving pulley 6 is connected to the rotation shaft of a pulse motor 9. The carriage 4 moves in the direction of width of recording paper 10 (that is, the main scanning direction) by being driven by the pulse motor 9.

An ink jet recording head 2 (hereunder referred to as a recording head 2) is mounted on a bottom face of the carriage 4, which faces the recording paper 10. This recording head 2 ejects ink, which is supplied from an ink cartridge 11, as an ink droplet from a nozzle orifice 3 (see FIG. 3). Thus, when recording an image, the printer 1 causes the recording head 2 to eject ink droplets in synchronization with the movement in the main scanning direction of the carriage 4. Moreover, the printer 1 causes a paper feeding roller 12 to rotate in such a way as to be interlocked with a reciprocating movement. Thus, the recording paper 10 is moved in a paper feeding direction. Consequently, images and characters are recorded on the recording paper 10 according to print data.

Figure 2:
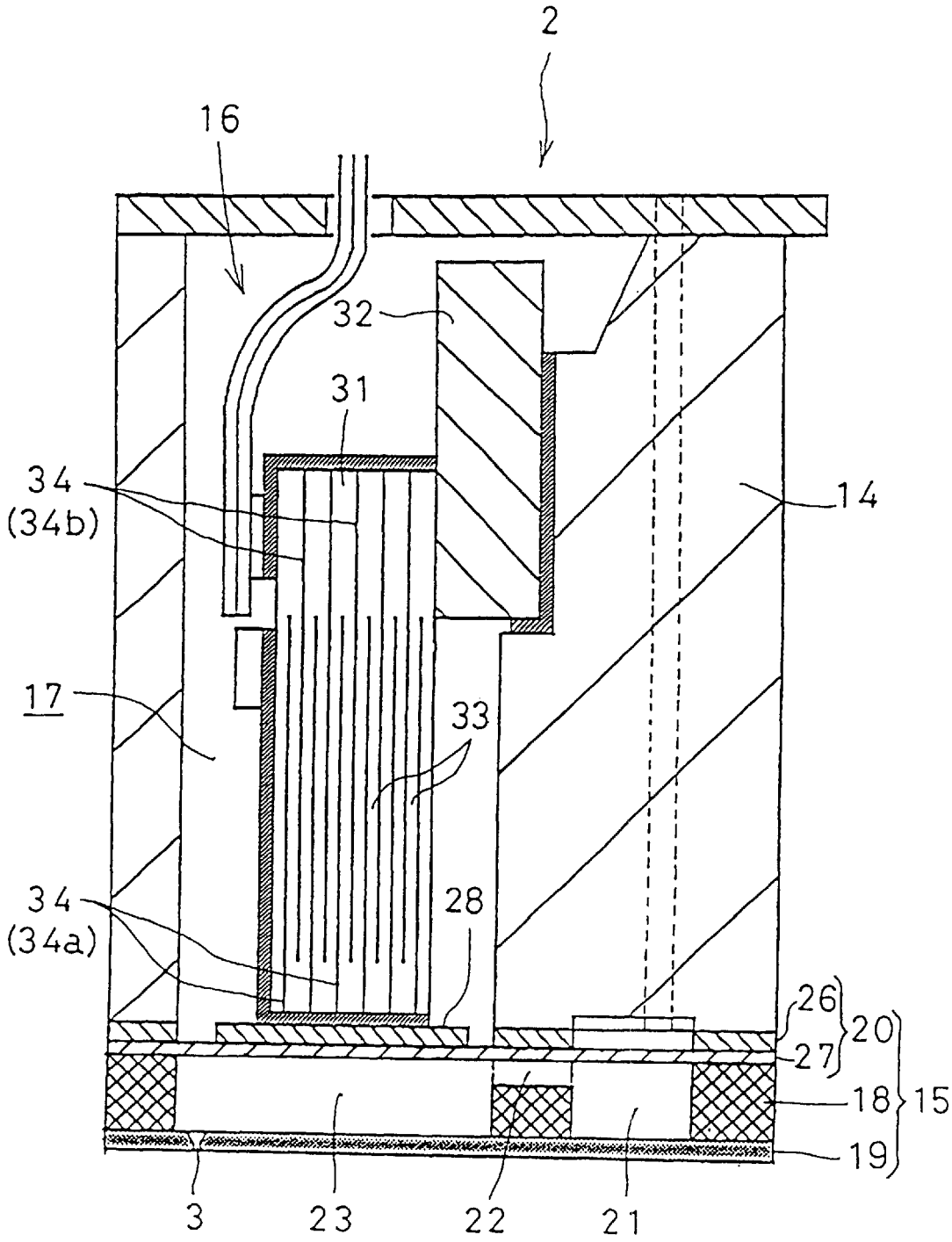
FIG. 2 is a sectional view illustrating an ink jet recording head.

As shown in FIG. 2, the recording head 2 has a case 14, a channel unit 15, and a vibrator unit 16, and is constructed by connecting the channel unit 15 to an end face of the case 14 and accommodating and fixing the vibrator unit 16 in the case 14.

The case 14 is formed like a housing, in which an accommodating space 17 for accommodating and fixing the vibrator unit 16 therein, and molded from, for example, resin. This accommodating space 17 is formed contiguously through the case 14 such that openings are formed at one side face connected to the channel unit 15, and the opposite side face thereof.

The channel unit 15 is configured so that a nozzle plate 19 is connected to one of faces of a channel forming substrate 18, and that a diaphragm 20 is connected to the other face of the substrate 18. The channel forming substrate 18 is a plate-like member in which an ink channel consisting of a common ink reservoir 21, an ink supply port 22 and a pressure chamber 23 is formed. The pressure chamber 23 is formed as a chamber elongated in a direction perpendicular to a direction in which nozzle orifices 3 are arranged in a row. The ink supply port 22 is formed as a constricted portion that is a narrow channel communicating between the pressure chamber 23 and the common ink reservoir 21. The common ink reservoir 21 is used for supplying ink, which is stored in the ink cartridge 11, to each of the pressure chambers 23.

Figure 3:
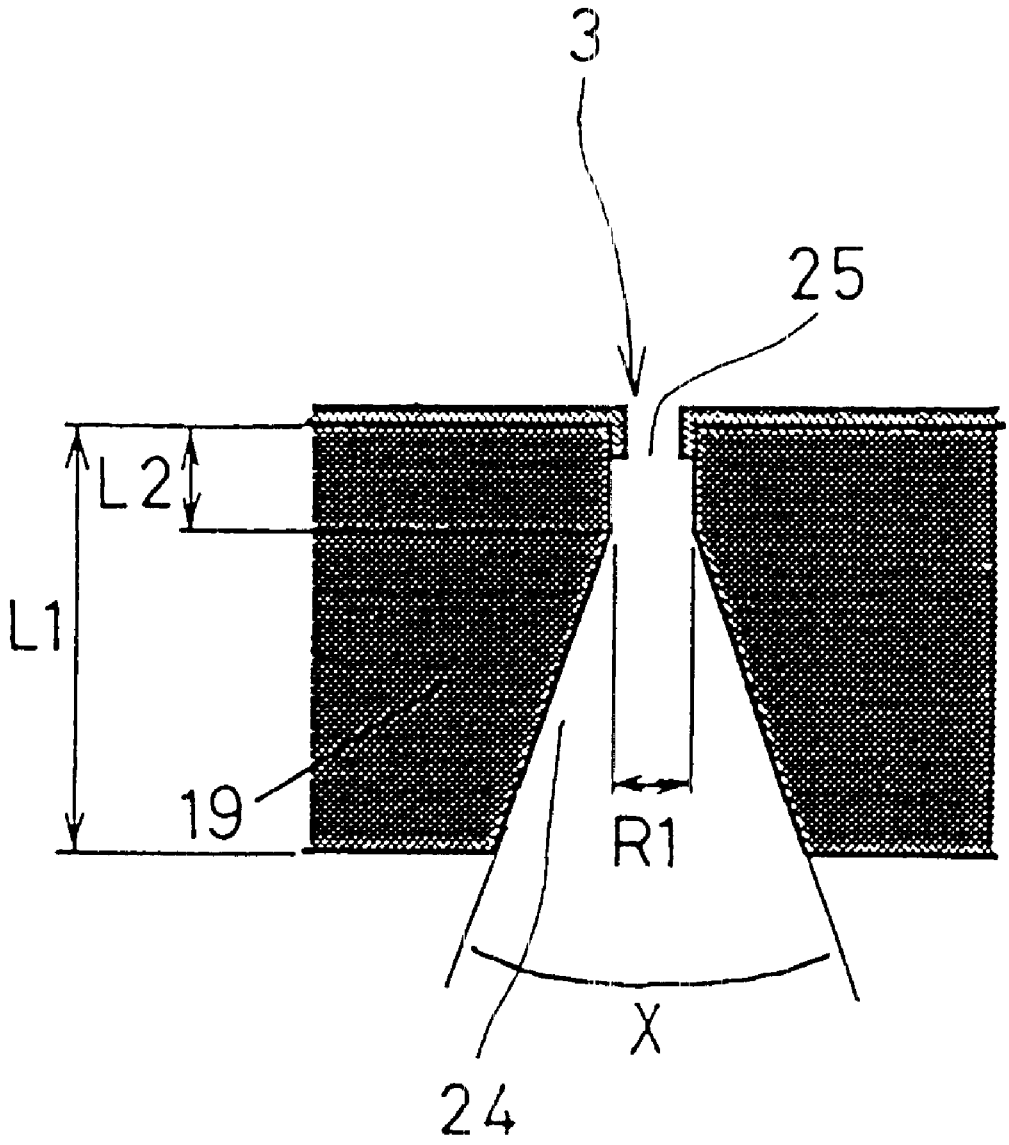
FIG. 3 is a sectional view illustrating the shape of a nozzle orifice.

A plurality of nozzle orifices 3 (for instance, 96 nozzle orifices) are opened as an array at pitches, which correspond to a dot formation density, in the nozzle plate 19. As shown in FIG. 3, the nozzle orifice 3 is a space formed nearly like a funnel in such a manner as to penetrate the nozzle plate 19 in a direction of thickness thereof. That is, the nozzle orifice 3 is a continuous space consisting of a tapered space (that is, a diameter varying space) 24, which is formed like a frustum of a circular cone so that the diameter of each transversal section thereof increases toward the pressure chamber 23 from a narrowed part placed in the middle portion in the direction of thickness of the nozzle plate 19, and a cylindrical straight space (that is, an equidiameter space) 25 provided in such a manner as to be continuous with the narrowed part of the tapered space 24. The tapered space 24 is provided at the inner side, that is, at the side of the pressure chamber 23, while the straight space 25 is provided at the outer side, that is, at the ink ejecting side.

In this embodiment, the thickness of the nozzle plate 19, that is, the length L1 of the nozzle orifice 3 is 0.080 mm. The inside diameter R1 of the straight space 25 is 0.032 mm. The length L2 of the straight space 25 is 0.025 mm. The inside diameter of the narrowed part of the tapered space 24 is 0.025 mm, which is equal to that of the straight space 25. The inside diameter of the narrowed part of the tapered space 24 is 0.032 mm, which is equal to that of the straight space 25. A vertex angle X is 32 degrees. Here, the shape of the nozzle orifice 3 is not limited to this one. For example, the space 24 may be constituted only by one of the straight space 25 and the tapered space 24. The shape of the tapered space 24 is not limited to the frustum of a circular cone. The tapered space 24 may be formed as a flared space.

The diaphragm 20 employs a double structure in which a resin elastic film 27, such as a PPS (polyphenylene sulfide) film, is overlaid on a stainless support substrate 26. Each of portions of the diaphragm 20, which respectively correspond to the pressure chambers 23, has a stainless plate part which is annularly etched. An island portion 28 is formed in the etched portion. A diaphragm portion consists of this island portion 28 and the elastic film 27 provided under and around the island portion 28. This diaphragm portion deforms in response to an operation of a piezoelectric vibrator 31 of the vibrator unit 16. Thus, the capacity of the pressure chamber 23 is variable.

The vibrator unit 16 consists of plural piezoelectric vibrators 31 installed in a row and a fixation base 32 that supports these piezoelectric vibrators 31. The piezoelectric vibrators 31 are manufactured by processing a vibrator substrate, in which piezoelectric materials 33 and electrodes 34 are alternately overlaid one after another, in such a way as to be formed in a pectinate manner. The fixation base 32 is connected to a base end portion of this pectinate vibrator by boding. This vibrator unit 16 is accommodated and fixed in the accommodating space 17 by being inserted thereinto in such a manner as to be in a posture in which an end of each of the piezoelectric vibrators 31 faces the opening, and by then bonding the fixation base 32 to the inner wall of the accommodating space 17. In such an accommodated state, an end face of each of the piezoelectric vibrators 31 abuts against and is fixed to the associated island portion 28 on the diaphragm 20. Therefore, when the piezoelectric vibrators 31 are elongated, the diaphragm portion is pushed against the pressure chamber 23, so that the pressure chamber 23 contracts. Conversely, when the piezoelectric vibrator 31 contracts, the diaphragm portion is pulled to a side opposite to the pressure chamber 23, so that the pressure chamber 23 expands.

The piezoelectric vibrator 31 serves as a pressure generating element of the invention. The exemplified piezoelectric vibrator 31 is operated in a longitudinal oscillation mode, in which this element expands and contracts in the longitudinal direction perpendicular to the overlaying direction, by providing electric potential difference between the electrodes 34. That is, the electrodes 34 include a common electrode 34*a*, whose potential is set to be a reference potential, and a drive electrode 34*b*, whose potential is set to be the potential of a drive signal (to be described later). A piezoelectric element 33 sandwiched between the electrodes 34*a* and 34*b* deforms according to the potential difference applied therebetween, so that the piezoelectric vibrator 31 expands and contracts. Although arbitrary potential may be set as the reference voltage, GND potential is set as the reference potential in this embodiment. Therefore, the closer to GND potential the drive potential becomes, the more the piezoelectric vibrator 31 expands. The more the drive potential is higher than GND potential, the more the piezoelectric vibrator 31 contracts. Thus, the closer to GND potential the drive potential becomes, the more the capacity of the pressure chamber 23 decreases. The more the drive potential is higher than GND potential, the more the piezoelectric vibrator 31 expands.

Thus, in the case of the exemplified recording head 2, the capacity of the pressure chamber 23 can be changed by controlling the expansion and contraction of the piezoelectric vibrators 31. That is, the pressure of ink contained in the pressure chamber 23 can be varied. For example, the pressure of the ink can be lowered by expanding the pressure chamber 23. Conversely, the pressure of the ink can be increased by contracting the pressure chamber 23. The pressure of the ink can be largely changed by rapidly changing the electric potential of the drive signal. Moreover, the capacity of the pressure chamber 23 can be changed by slowly changing the potential of the drive signal while restraining the fluctuation of the ink pressure. Ink droplets can be ejected from the nozzle orifice by controlling the pressure fluctuation of the ink contained in the pressure chamber 23.

Figure 4:
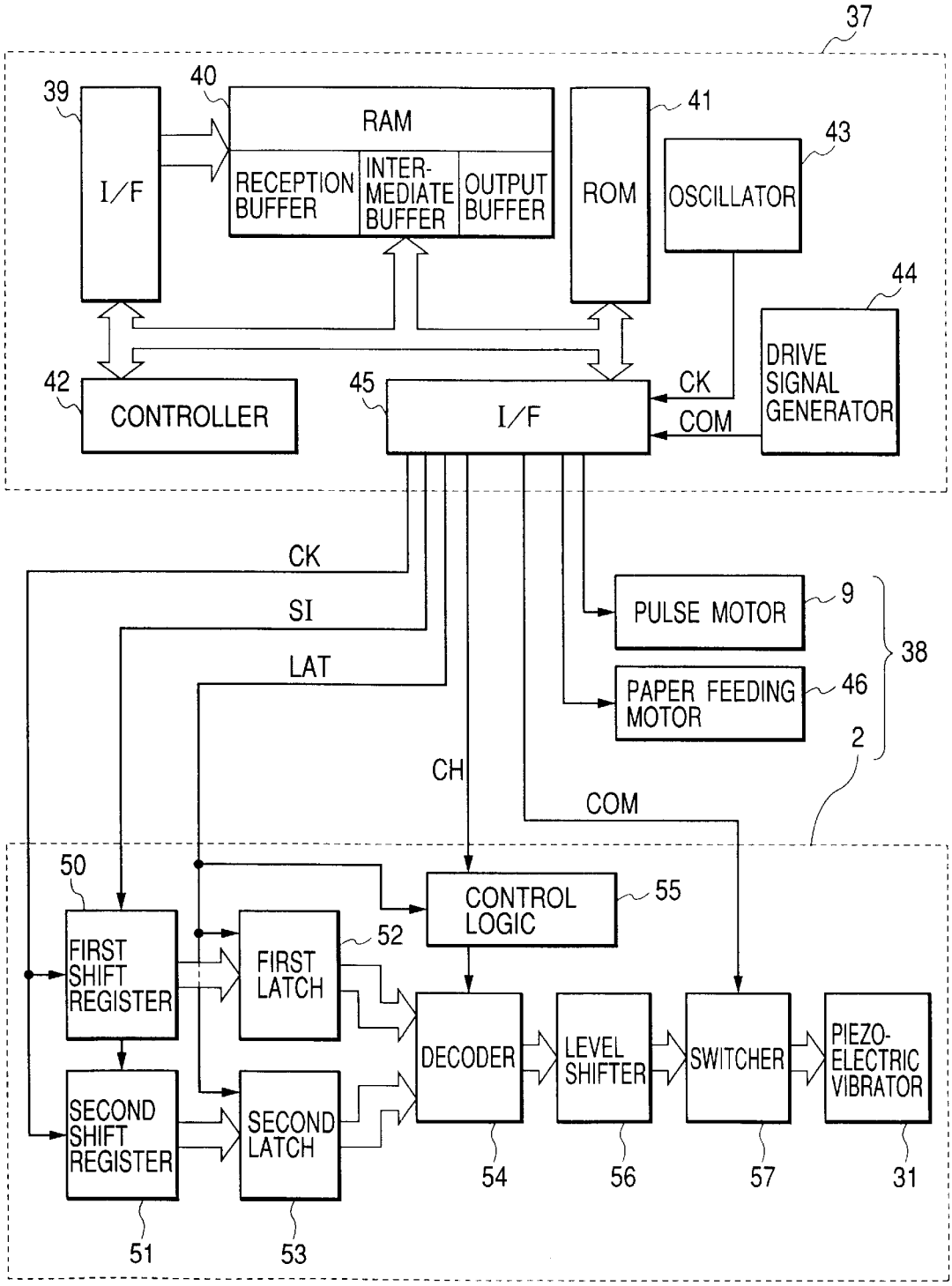
FIG. 4 is a block view illustrating the electrical configuration of the ink jet recording apparatus.

Next, the electrical configuration of the printer 1 is described hereinbelow. As illustrated in FIG. 4, the printer 1 has a printer controller 37 and a print engine 38.

The printer controller 37 has an interface 39 (hereunder referred to an external I/F 39) for receiving print data from a host computer (not shown), a RAM 40 for storing various kinds of data, a ROM 41 for storing routines to be executed for various kinds of data processing, a controller 42 constituted by a CPU, an oscillator 43 for generating clock signals (CK), a drive signal generator 44 for generating drive signals (COM) to be supplied to the recording head 2, and an interface 45 (hereunder referred to an internal I/F 45) for transmitting print data (SI) and drive signals to the print engine 38.

The external I/F 39 receives print data, which consists of one or a plurality of character code data, graphic function data, and image data, from the host computer. The external I/F 39 outputs a busy signal (BUSY) and an acknowledge signal (ACK) to the host computer.

The RAM 40 is used as a reception buffer, an intermediate buffer, an output buffer, and a work memory (not shown). The reception buffer temporarily stores print data received by the external I/F 39 from the host computer. The intermediate buffer stores intermediate code data converted by the controller 42 into intermediate codes. Print data (that is, dot pattern data) corresponding to each of dots is loaded into the output buffer. The ROM 41 stores various kinds of control routines to be executed by the controller 42, and also stores font data, graphic function data, and various kinds of procedure data.

The controller 42 reads the print data stored in the reception buffer and then converts the read print data into intermediate code data. Further, the controller 42 analyzes the intermediate code data read from the intermediate buffer and refers to the font data and the graphic function data and expands the intermediate code data into the print data. This print data is constituted by data representing, for example, 2-bit gradation information. This expanded print data is stored in the output buffer. When the print data corresponding to a single line of the recording head 2 is obtained, the serial transmission of the print data (SI) of this single line to the recording head 2 through the internal I/F 45 is performed. When the print data of a single line is transmitted from the output buffer, the data stored in the intermediate buffer is deleted. Then, a conversion is performed on the next intermediate code data. Furthermore, the controller 42 supplies a latch signal (LAT) and a channel signal (CH) to the recording head 2 through the internal I/F 45. These latch and channel signals provide timing with which the supply of each of pulse signals of a drive signal (to be described later) is started.

The drive signal generator 44 generates a sequence of drive signals including drive pulses each constituted by a plurality of waveform components. This drive signal generator 44 may be configured in such a manner as to generate a waveform signal having a desired waveform shape by mounting a CPU thereon. Alternatively, this drive signal generator 44 may be constituted by an analog circuit to thereby generate a waveform signal having a waveform of a desired shape. Here, this drive signal will be described in detail later.

The print engine 38 comprises an electric driving system for the recording head 2, and also comprises the pulse 9 for moving the carriage 4, and the paper feeding motor 46 for rotating the paper feeding roller 12.

The electric driving system for the recording head 2 has a shift register circuit consisting of a first shift register 50 and a second shift register 51, a latch circuit consisting of a first latch 52 and a second latch 53, a decoder 54, a control logic 55, a level shifter 56, a switcher 57, and a piezoelectric vibrator 31. Further, a plurality of groups each consisting of the shift registers 50 and 51, the latches 52 and 53, the decoder 54, the switcher 57, and the piezoelectric vibrators 31 are provided in such a way as to respectively correspond to the nozzle orifices 3. Furthermore, the recording head 2 ejects ink droplets according to the print data (representing gradation information) received from the printer controller 37.

That is, the print data (SI) sent from the printer controller 37 is serially-transmitted from the internal I/F 45 to the first shift register 50 and the second shift register 51 in synchronization with the clock signal (CK) sent from the oscillator 43. The print data (SI) sent from the printer controller 37 is 2-bit data, as described above, and represents four gradation levels respectively corresponding to a non-recording mode, a microdot mode, a middle dot mode, and a large dot mode. Here, in this embodiment, the non-recording mode is designated by gradation information "00". The microdot mode is designated by gradation information "01". The middle dot mode is designated by gradation information "10". The large dot mode is designated by gradation information "11".

This print data is set correspondingly to each of dots, that is, correspondingly to each of the nozzle orifices 3. Data represented by the low-order bit (that is, bit 0) corresponding to each of all the nozzle orifices 3 is inputted to the first shift register 50. Data represented by the high-order bit (that is, bit 1) corresponding to each of all the nozzle orifices 3 is inputted to the first shift register 51. The first latch 52 is electrically connected to the first shift register 50. The second latch 53 is electrically connected to the second shift register 51. Further, when a latch signal (LAT) outputted from the printer controller 37 is inputted to each of the latches 52 and 53, the first latch 52 latches the data represented by the low-order bit of the print data, while the second latch 53 latches the data represented by the high-order bit of the print data.

The print data latched by each of the latch circuits 52, 53 is inputted to the decoder 54. This decoder 54 translates the 2-bit print data (representing the gradation information) and generates selection data. This pulse selection data is constituted by a plurality of bits, each of which corresponds to a corresponding one of pulse signals that constitute a drive signal (COM). In accordance with data (for instance, "0" or "1") represented by each of the bits, it is selected whether the pulse signal is to be supplied or not.

Further, a timing signal sent from the control logic 55 is inputted to the decoder 54. Moreover, the control logic 55 generates a timing signal each time when receiving a latch signal (LAT) or a channel signal (CH). The bits of the pulse selection data translated by the decoder 54 are inputted to the level shifter 56 in the order from the high-order bit, each time when timing to be provided in response to the timing signal comes.

The level shifter 56 serves as a voltage amplifier. When the pulse selection data is "1", the level shifter 56 outputs an electric signal representing a voltage raised to a predetermined level, for example, several tens of volts at which the switcher 57 can be driven. The pulse data representing "1", which corresponds to the electric signal representing the voltage raised to such a level, is supplied to the switcher 57.

This switcher 57 supplies drive pulses, which are included in a drive signal, to the piezoelectric vibrator 31 according to the pulse selection data generated by the translation of the print data. That is, a drive signal generated in the drive signal generator 44 is inputted to the input side of this switcher 57. The piezoelectric vibrator 31 is connected to the output side of the switcher 57. Further, during the pulse selection data applied to the switcher 57 represents "1", the switcher 57 is in a conducted state, and supplies the drive signal to the piezoelectric vibrator 31. The potential level of the piezoelectric vibrator 31 (that is, the potential level at the drive electrode 34*b*) changes in response to this drive signal. On the other hand, during the pulse selection data applied to the switcher 57 represents "0", the level shifter 56 outputs no electric signals, in response to which the switcher 57 is operated. Thus, the switcher 57 is brought into a non-conducted state, so that no drive signals are supplied to the piezoelectric vibrator 31. Here, in the time period during the pulse selection data represents "0", the level of the potential at the piezoelectric vibrator is maintained at that of the potential just before the value represented by the pulse data is changed to "0".

Next, a drive signal COM generated by the aforementioned drive signal generator 44, and an operation of supplying each of the drive pulses constituting the drive signal COM are described hereinbelow.

Figure 5:
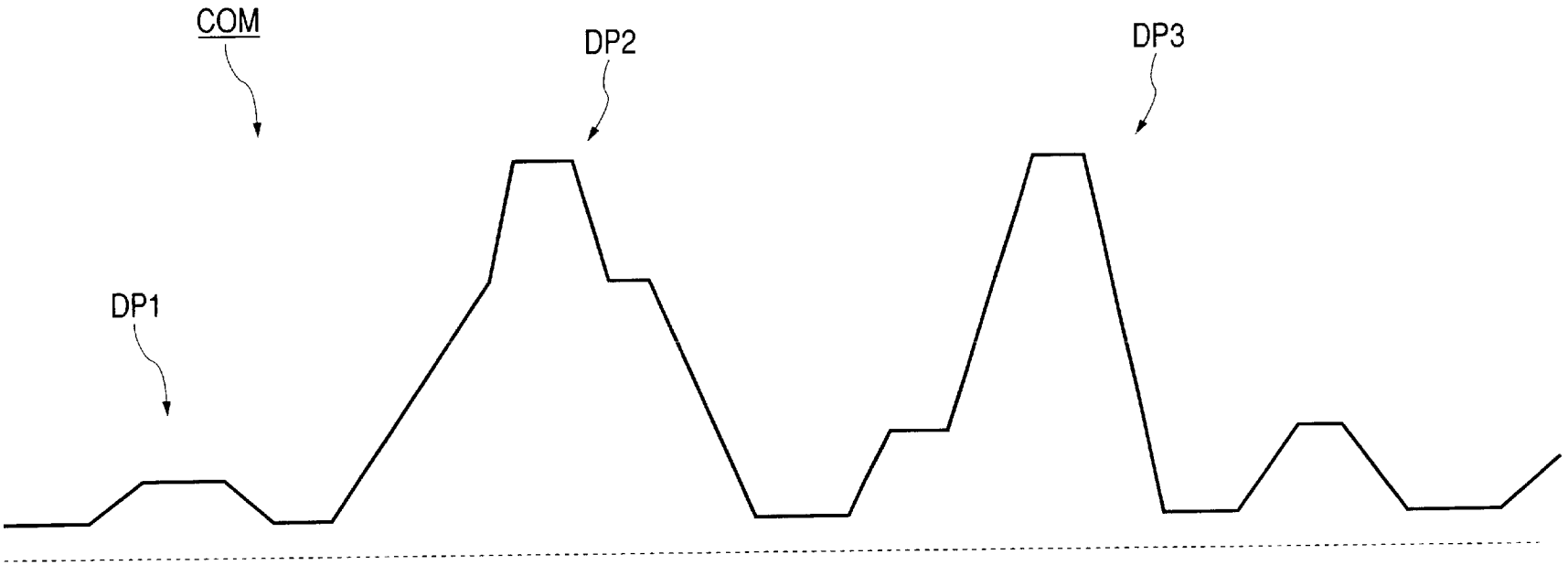
FIG. 5 is a view illustrating a drive signal.

The drive signal COM generated by the drive signal generator 44 is a signal constituted by consecutively connecting a plurality of kinds of drive pulses corresponding to different amounts of ink. For instance, as shown in FIG. 5, the drive signal COM includes a vibrating pulse DP1 for vibrating the meniscus of ink such an extent that an ink droplet is not ejected from the nozzle orifice 3, a microdot drive pulse DP2, which is generated after the generation of this vibrating pulse DP1, for causing the head to eject an ink droplet for forming a microdot, and a middle dot drive pulse DP3 for causing the head to eject an ink droplet for forming a middle dot. The drive signal generator 44 repeatedly generates these drive pulses DP1, DP2, and DP3 every printing period.

In the case of inhibiting the head from ejecting ink droplets, only the vibrating pulses DP1 of this drive signal COM are selected and supplied to the piezoelectric vibrator 31. In the case of recoding microdots, only the microdot drive pulses DP2 are supplied to the piezoelectric vibrator 31. In the case of recording middle dots, only the middle dot drive pulses DP3 are supplied to the piezoelectric vibrator 31. In the case of recoding large dots, the microdot drive pulses DP2 and the middle dot drive pulses DP3 are supplied to the piezoelectric vibrators 31.

That is, the decoder 54 generates the pulse selection data "100" by translating the gradation information "00" corresponding to the non-recording mode. Further, the decoder 54 generates the pulse selection data "010" by translating the gradation information "01" corresponding to the microdot mode. Moreover, the decoder 54 generates the pulse selection data "001" by translating the gradation information "10" corresponding to the middle dot mode. Furthermore, the decoder 54 generates the pulse selection data "011" by translating the gradation information "11" corresponding to the large dot mode. Then, the decoder 54 inputs each of the bits of the pulse selection data to the level shifter 56 in synchronization with the timing with which the supply of a corresponding one of the drive pulses DP1 to DP3 is started.

Figure 6:
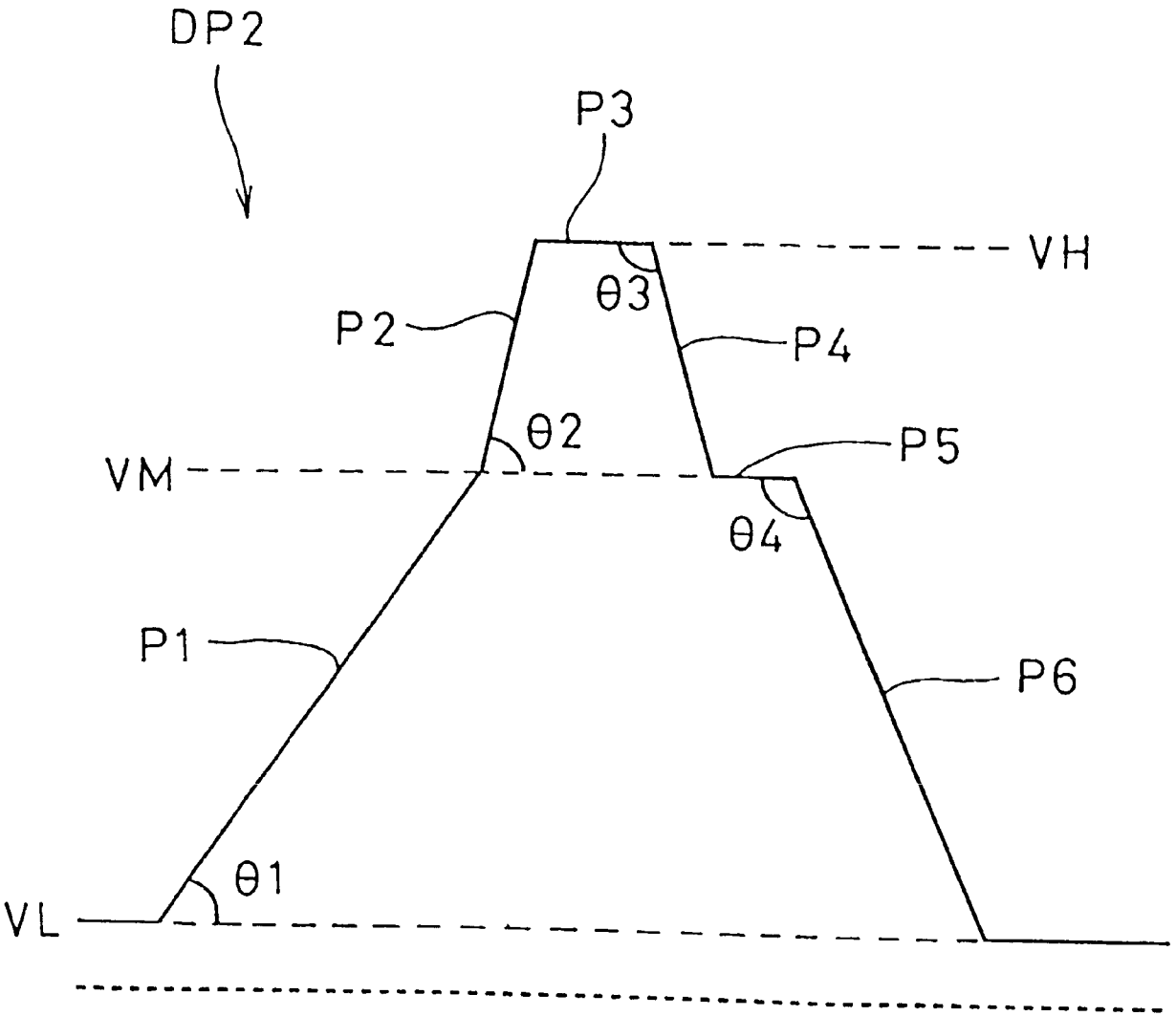
FIG. 6 is a view illustrating a microdot drive pulse according to a first embodiment of the invention.

Next, the microdot drive pulse DP2 is described in detail hereinbelow with reference to FIG. 6. When the recording head 2 is driven in response to this microdot drive pulse DP2, a central portion M1 of the meniscus M swells upwardly in such a manner as to become a column, as shown in FIGS. 7D and 7E. A main ink droplet is separated from the end portion of this ink column and jetted. Subsequently, a satellite ink droplet is separated from the remaining part of the ink column and jetted in such a way as to follow the main ink droplet. That is, the satellite ink droplet is jetted in such a manner as to accompany the main ink droplet. The shape of the waveform of this microdot drive pulse DP2 is set so that the amount of ink of the satellite ink droplet is more than the amount of ink of the main ink droplet.

This microdot drive pulse DP2 is a signal constituted by consecutively and serially connecting a first charging component P1 serving as a first decompressing component, a second charging component P2 serving as a second decompressing component, a first holding component P3 serving as a decompressed state holding component, a first discharging component P4 serving as a first compressing component, a second holding component P5 serving as a compressed state holding component, and a second discharging component P6 serving as a second compressing component.

The first charging component P1 is a component for raising the potential from the lowest potential VL to an intermediate potential VM with a relatively small gradient θ1. When this first charging component P1 is supplied to the piezoelectric vibrator 31, the capacity of the pressure chamber 23 relatively slowly increases from the minimum capacity provided at the lowest potential VL to the intermediate capacity provided at the intermediate potential VM, so that the pressure of ink contained in the pressure chamber 23 is slowly decreased (a first decompressing step).

Figure 7A:
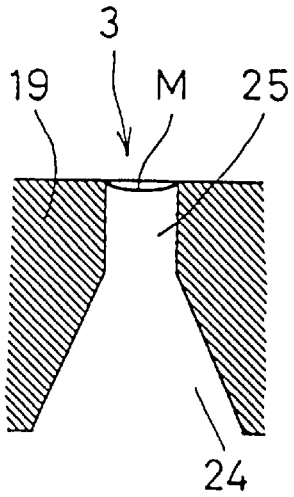
FIGS. 7A to 7F are views each illustrating a process of ejecting an ink droplet.
Figure 7B:
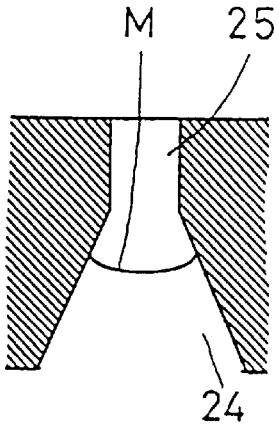

With this slow reduction in the pressure, the meniscus changes the state thereof from a stationary state shown in FIG. 7A to a first decompressed state shown in FIG. 7B. Here, the expression "stationary state" is a state in which there is an extremely little fluctuation in the internal pressure of the pressure chamber 23, and in which the meniscus M is placed in the vicinity of a nozzle formation face (that is, the outer face of the nozzle plate 19). In this stationary state, the meniscus M is slightly concaved with gentle curvature at the side of the pressure chamber 23. The first decompressed state is a state in which the meniscus M is pulled into a midway of the nozzle orifice 3 toward the pressure chamber 23. Here, in this embodiment, the meniscus M is pulled into a middle part of the tapered space 24.

Further, the gradient θ1 of the first charging component P1, that is, the expansion speed of the pressure chamber 23, which is expanded with the supply of the first charging component, is set at a value at which the curved shape of the meniscus in the stationary state can be maintained. This setting is performed so as to pull the meniscus M thereinto during the curved shape is maintained. When the meniscus is pulled into the midway of the tapered space 24, the amount of ink filled into the nozzle orifice 3 decreases because the inside diameter of the nozzle orifice 3 is enlarged. Consequently, the inertance of ink in the nozzle orifice 3 can be decreased. Thus, the response of the meniscus to the pressure fluctuation of ink contained in the pressure chamber is enhanced.

The second charging component P2 is a component for raising the potential from the intermediate potential VM to the highest potential VH with a raising gradient θ2. When this second charging component P2 is supplied to the piezoelectric vibrator 31, the capacity of the pressure chamber is rapidly increased from the intermediate capacity provided at the intermediate potential VM to the maximum capacity provided at the highest potential VH, so that the pressure of ink contained in the pressure chamber 23 is rapidly decreased (second decompressing step).

Figure 7C:
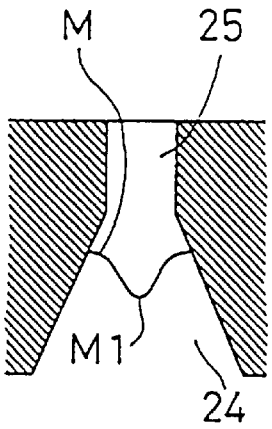
Figure 7D:
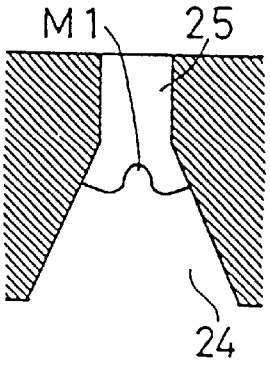
Figure 7E:
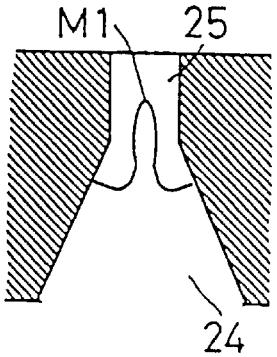

With this rapid reduction in the pressure, the meniscus changes the state thereof from the first decompressed state shown in FIG. 7B to a second decompressed state shown in FIG. 7C. Here, the second decompressed state is a state in which the meniscus M having been pulled to the side of the pressure chamber 23 at the first decompressing step is pulled thereto still more.

Further, the gradient θ2 of the second charging component P1 (or the expansion speed of the pressure chamber 23, which is expanded with the supply of the second charging component P2) is set in such a way as to be than the gradient θ1 of the first charging component P1 (or the expansion speed of the pressure chamber 23). Preferably, the gradient θ2 (or the expansion speed) is set at a controllable maximum value. This setting is performed so as to locally pull the central portion M1 of the meniscus M toward the pressure chamber 23.

That is, when this second charging component P2 is supplied into the piezoelectric vibrator 31, the pressure of ink contained in the pressure chamber 23 is rapidly reduced. At that time, the central portion M1 of the meniscus M is locally pulled thereinto as illustrated in FIG. 7C, because the response of the meniscus M to the pressure fluctuation in the pressure chamber 23 is enhanced at the first decompressing step. That is, a locally concaved portion having a curvature, which is larger than that of a peripheral edge, is formed in the central portion M1 of the meniscus M.

The first holding component P3 is a component for maintaining the immediately precedent potential, that is, the highest potential VH, which is the terminal potential of the second charging component, over a predetermined time period. When this first holding component P3 is supplied to the piezoelectric vibrator 31, the contraction of the piezoelectric vibrator 31 is stopped, thereby the expansion of the pressure chamber 23 is stopped. That is, the maximum capacity of the pressure chamber 23 is maintained (holding step). In a time period in which this first holding component P3 is supplied, the locally concaved portion, which is largely pulled toward the pressure chamber 23 at the second decompressing step, reacts, that is, a restoring force due to the face tension of this portion reverses the direction of movement thereof to an ejecting direction in which ink droplets are ejected. Thereafter, as shown in FIG. 7D, the central portion M1 of the meniscus M is brought into a convex condition in which the central portion M1 upwardly swells in the ejecting direction owing to an inertial force.

Therefore, this first holding component P3 determines a holding time for causing the central portion M1 of the meniscus M locally pulled thereinto at the second decompressing step to react and move in the ejecting direction. The central portion M1 of the meniscus M performs free oscillation over this holding time.

The first discharging component P4 is a component for lowering the potential from the highest potential VH to the intermediate potential VM with a steeply lowering gradient θ3 to thereby contract the pressure chamber 23. When this first discharging component P4 is supplied to the piezoelectric vibrator 31, the piezoelectric vibrator 31 is slightly elongated, so that the capacity of the pressure chamber 23 is rapidly decreased from the maximum capacity to the intermediate capacity. Consequently, the pressure of ink contained in the pressure chamber 23 rises. Moreover, the ink column is compressed. That is, as shown in FIG. 7E, the central portion M1 of the meniscus M extended like a column owing to the inertial force is pushed out in the ink ejecting direction due to a compressing force caused by the contraction of the pressure chamber 23. Thus, during the central portion M1 of the meniscus M moves in the ejecting direction as a reaction, the pressure chamber 23 is compressed. Consequently, the ink pressure outputted from the pressure chamber 23 is applied thereto as a reaction. Thus, the ink column can be strongly pushed out.

Further, timing, with which the supply of this first discharging component P4 is started, is provided by a time during which the first holding component P3 is supplied. Thus, the optimization of the timing, with which the ink column is pushed out, is achieved according to the setting of the time, during which the first holding component P3 is supplied.

Here, although the intermediate potential VM, which is the terminal potential of this first discharging component P4, is set to be equal to the initial potential of the second charging component P2 in this embodiment, the intermediate potential VM is not limited to this case. The initial potential of the second charging component P2 and the terminal potential of the first discharging component P4 can be set individually.

The second holding component P5 is a component for maintaining the intermediate potential VM, which is the terminal potential of the first discharging component P4. When this second holding component P5 is supplied to the piezoelectric vibrator 31, the expansion of the piezoelectric vibrator 31 is stopped. Further, the pressure chamber 23 maintains the capacity thereof at the intermediate capacity.

Figure 7F:
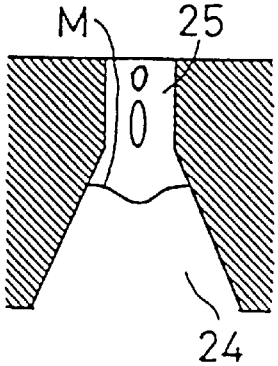

The second holding component P5 is a component for maintaining the intermediate potential VM, which is the terminal potential of the first discharging component P4. When this second holding component P5 is supplied to the piezoelectric vibrator 31, the expansion of the piezoelectric vibrator 31 is stopped. Further, the pressure chamber 23 maintains the capacity thereof at the intermediate capacity. At that time, as illustrated in FIG. 7F, the ink column pushed out in the ink ejecting direction in response to the first discharging component P4 is torn off the meniscus M owing to the inertial force. Then, the torn-off portion is jetted as an ink droplet, the amount of ink of which is extremely small and about 2 pL. Therefore, the step of supplying this holding component P5 and the step of supplying the first discharging component P4 correspond to the ejecting step.

During the second holding component P5 and the second discharging component P6 are supplied thereto, the ink column is extended in the direction, in which ink droplets are ejected, owing to the ink pressure applied from the pressure chamber and to the inertial force. Due to the extension of this ink column, first, a tip end portion of the ink column is torn off. Then, the torn-off portion is jetted as a satellite ink droplet. Thus, as illustrated in FIG. 7F, the main ink droplet and the satellite ink droplet are successively jetted.

Because the pressure outputted from the pressure chamber 23 is applied to the central portion M1 of the meniscus M when reacting at the step of supplying the first discharging component P4, the ink droplet ejected at the ejecting step is jetted at a speed, which is higher than that of the ink droplet in the case of the related apparatus. The ink droplet ejected at the ejecting step is jetted at 7 to 8 m/sec. Thus, even when the amount of ink of the ink droplet is extremely small, a sufficient jetting speed of the ink droplet is obtained. Moreover, the ink droplet can be impacted on a desired position. Consequently, the image quality is further enhanced.

The second discharging component P6 is a component for changing the potential from the intermediate potential VM to the lowest potential VL with a constant lowering gradient θ4. When this second discharging component P6 is supplied, the piezoelectric vibrator 31 is extended so that the capacity of the pressure chamber 23 decreases from the intermediate capacity to the minimum capacity. Consequently, the pressure chamber 23 is compressed. Here, the gradient θ4 corresponding to the second discharging component P6 is set in such a way as to restrain the meniscus M from moving toward the pressure chamber 23 after the ejection of the ink droplet. That is, when the ink droplet is ejected, the central portion M1 of the meniscus M moves toward the pressure chamber 23 as a reaction. The movement of this central portion M1 causes the entire meniscus M to oscillate. Thus, when the meniscus M is left as it is, it takes long time to converge the oscillation thereof. Thus, the second discharging component P6 is supplied and the pressure chamber 23 is compressed with timing at which the central portion M1 of the meniscus M moves toward the pressure chamber 23. Consequently, the movement of the central portion M1 of the meniscus M is restrained. Thus, the oscillation of the meniscus M can be damped in a short time. Moreover, a necessary time interval to the next ejection of an ink droplet can be shortened. Consequently, the printing period can be shortened. Moreover, an increase in the recording speed of the apparatus is achieved.

Furthermore, the timing, with which the supply of this second discharging component P6 is started, is provided by the time during which the second holding component P5 is supplied. Thus, the timing, with which the pressure chamber 23 is compressed, can be optimized according to the setting of the time during which the second holding component P5 is supplied. Consequently, the damping is effectively performed.

In the case of supplying the microdot driving pulse DP2 in this embodiment, the pressure chamber 23 is decompressed and the central portion M1 of the meniscus M is locally pulled thereinto by supplying the second charging component P2. Then, the inside of the pressure chamber 23 is compressed and the ink column is pushed out by supplying the first discharge component P4 during the locally pulled central portion M1 of the meniscus M moves in the ejecting direction as a reaction. Thus, the amount of ink of the ink droplet can be increased in such a way as to be more than that of ink of the main ink droplet. Here, as is apparent from the comparison between the (initial) jetting speeds of the main ink droplet and the satellite ink droplet, the jetting speed of the main ink droplet is higher than that of the satellite ink droplet, similarly as in the case of the related microdot driving pulse. In short, the amount of ink of the main ink droplet, whose initial jetting speed is higher than that of the satellite ink droplet, is small, while the amount of ink of the satellite ink droplet, whose initial jetting speed is lower than that of the main ink droplet. Consequently, the impact positions of the main ink droplet and the satellite ink droplet can be made to coincide with each other.

That is, although the initial jetting speed of the main ink droplet is high, the amount of ink thereof is extremely small. Thus, the main ink droplet is more largely affected by the viscous resistance of air, as compared with the satellite ink droplet. Further, the rate of reduction in the ratio of the speed to the flight distance of the main ink droplet is high. Conversely, although the initial jetting speed of the satellite ink droplet is low, the amount of ink thereof is relatively large. Thus, the satellite ink droplet is unaffected by the viscous resistance of air, as compared with the main ink droplet. Further, the rate of reduction in the ratio of the speed to the flight distance of the main ink droplet is low. Therefore, the difference in speed at the impact position between the main ink droplet and the satellite ink droplet on the recording paper 10 can be reduced. Consequently, the impact position of the main ink droplet can be made to be closer to the impact position of the satellite ink droplet, as compared with the difference in the impact positions therebetween in the case of the related apparatus.

Figure 8:
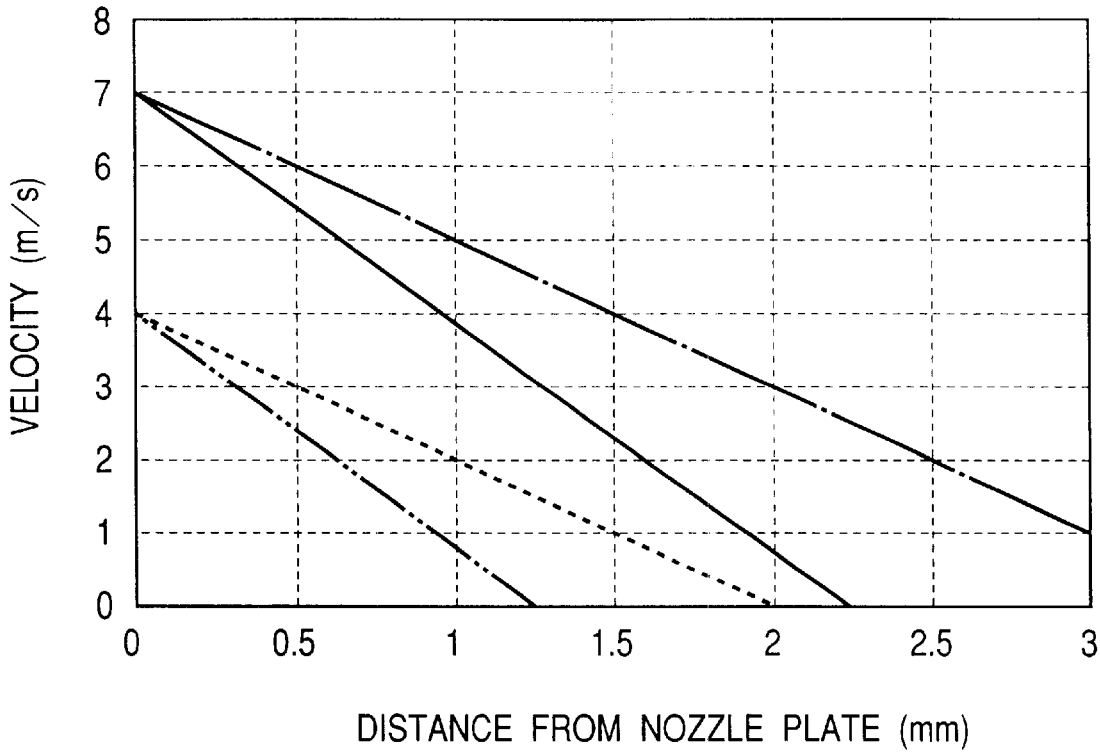
FIG. 8 is a graph showing the relation between the flight distance of an ink droplet from a nozzle plate and the jetting speed thereof in the first embodiment.

This is described in detail hereinbelow according to a practical example shown in FIG. 8, which is a graph showing the relation between the flight distance from the nozzle plate 19 and the jetting speed of an ink droplet. In this graph, a solid line indicates data of a main ink droplet ejected in response to the microdot drive pulse DP2 of this embodiment. A dashed line indicates data of a satellite ink droplet ejected in response to the microdot drive pulse DP2 of this embodiment. A chain line indicates data of a main ink droplet ejected in response to the microdot drive pulse in the related apparatus. A double-dashed chain line indicates data of a satellite ink droplet ejected in response to the microdot drive pulse in the related apparatus. Here, the amount of ink of the main ink droplet of this embodiment is 0.5 pL, while the amount of ink of the satellite ink droplet of this embodiment is 1.0 pL. On the other hand, the amount of ink of the main ink droplet in the case of the related apparatus is 1.0 pL, while the amount of ink of the satellite ink droplet in the case of the related apparatus is 0.5 pL.

First, such relation in the case of the main ink droplet ejected in this embodiment (corresponding to the solid line) is compared with that of the main ink droplet ejected in the related apparatus (corresponding to the chain line). The initial jetting speed (that is, the jetting speed at a distance of 0 mm) in the case of the main ink droplet in the related apparatus is about 7.0 m/s. Further, as the flight distance increases, the jetting speed thereof decreases. However, since the amount of ink thereof is relatively large (1.0 pL), the rate of reduction in the ratio of the jetting speed to the flight distance is relatively low. The jetting speeds respectively corresponding to distances of 1.0 mm, 2.0 mm, and 3.0 mm are about 5.0 m/s, 3.0 m/s. and 1.0 m/s. On the other hand, similarly, the initial jetting speed in the case of the main ink droplet in the present embodiment is about 7.0 m/s. Further, as the flight distance increases, the jetting speed thereof decreases. However, the amount of ink thereof is extremely small (0.5 pL), so that the rate of reduction in the ratio of the jetting speed to the flight distance is relatively high. The jetting speeds respectively corresponding to distances of 1.0 mm, 2.0 mm, and 2.25 mm are about 3.8 m/s, 0.7 m/s and 0 m/s.

Next, such relation in the case of the satellite ink droplet ejected in this embodiment (corresponding to the dashed line) is compared with that of the satellite ink droplet ejected in the related apparatus (corresponding to the double-dashed chain line). The initial jetting speed in the case of the satellite ink droplet in the related apparatus is about 4.0 m/s. Further, the amount of ink thereof is extremely small (0.5 pL), so that the rate of reduction in the ratio of the jetting speed to the flight distance is relatively high. The jetting speeds respectively corresponding to distances of 1.0 mm, and 1.25 mm are about 0.7 m/s and 0 m/s. On the other hand, similarly, the initial jetting speed in the case of the satellite ink droplet in the present embodiment is about 4.0 m/s. However, since the amount of ink thereof is relatively large (1.0 pL), as compared with that of ink of the satellite ink droplet in the related apparatus, so that the rate of reduction in the ratio of the jetting speed to the flight distance is relatively low, as compared with that of reduction in such a ratio in the case of the related apparatus. The jetting speeds respectively corresponding to distances of 1.0 mm, and 2.0 mm are about 2.0 m/s, and 0 m/s.

Here, when the distance from the nozzle plate 19 to the recording paper 10 is 1.0 mm, the jetting speed of the main ink droplet in the related apparatus is about 5.0 m/s at the impact position, while the speed of the satellite ink droplet in such a case is about 0.7 m/s. Thus, the difference between both of these ink droplets is large, so that it takes relatively long time until the satellite ink droplet impacts since the main ink droplet impacts. Further, during the recording head 2 moves, ink droplets are ejected therefrom. Thus, the difference in the impact position between both of these ink droplets increases. On the other hand, in this embodiment, the speed of the main ink droplet at the impact position is about 3.8 m/s, and the speed of the satellite ink droplet is about 2.0 m/s. Thus, the difference in the speed between the main ink droplet and the satellite ink droplet ejected in this embodiment is smaller than such difference in the case of the related apparatus. Therefore, the main ink droplet and the satellite ink droplet successively impact on the recording paper, so that the difference in the impact position therebetween is reduced.

Further, when the distance from the nozzle plate 19 to the recording paper 10 is 1.5 mm, the speed of the satellite ink droplet becomes 0 m/s before the ink droplet impacts thereon in the related apparatus. Thus, there is probability that the ink droplets become mists and floats in the air. In contrast, in this embodiment, the speed of the main ink droplet at the impact position is about 3.3 m/s, and the speed of the satellite ink droplet at the impact position is about 1.0 m/s. Consequently, the ink droplets are enabled to reliably impact on the recording paper 10. Moreover, the ink droplets are prevented from becoming mists.

As described above, in the case of supplying the microdot drive pulse DP2 according to this embodiment, the difference in potential among the components and the time period during which each of the components (thus, the shape of the waveform of each of the components) are set so that the amount of ink of the satellite ink droplet is larger than the amount of ink of the main ink droplet. Thus, even when microdot ink droplets, the amounts of ink of which are extremely small, are ejected, the impact positions of the main ink droplet and the satellite ink droplet can be made to coincide with each other. Thus, the image quality is improved. Moreover, the ink droplets are prevented from becoming mists. Furthermore, the reliability of the apparatus is enhanced.

Here, although the meniscus M is pulled into the tapered space 24 of the nozzle orifice 3 at the first decompressing step, the invention is not limited to this case. Similar effects are obtained by pulling the meniscus M into a midway of the straight space 25, as illustrated in FIG. 9B, at, for example, the first decompressing step in response to the first charging component P1.

Figure 9A:
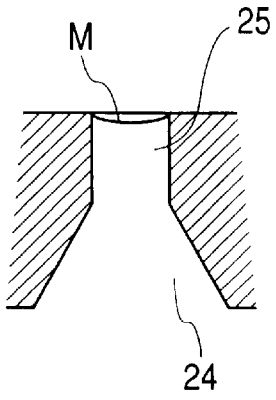
FIGS. 9A to 9C are views each illustrating another example of the process of ejecting an ink droplet.
Figure 9B:
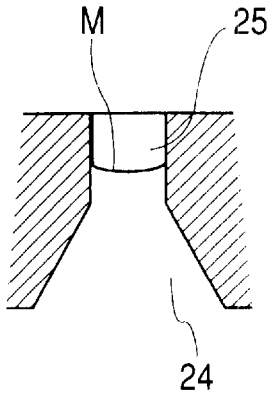

That is, it turns out from the comparison between a state, in which nearly the entire straight space 25 is filled with ink up to the opening edge of the nozzle orifice 3 as shown in FIG. 9A, and a state, in which ink fills in the straight space 25 up to a midway thereof as shown in FIG. 9B, that the amount of ink filled in the straight space 25 in the latter state is smaller than the amount of ink filled in the portion 25 in the former state. Thus, the inertance in the latter state is less than that in the former state. Therefore, the inertance can be reduced by pulling the meniscus M thereinto.

Here, the inertance is largely affected by the straight space 25 that is the most narrowed portion of the ink channel. Therefore, the inertance is sufficiently lowered only by pulling the meniscus into a middle part of the straight space 25.

Figure 9C:
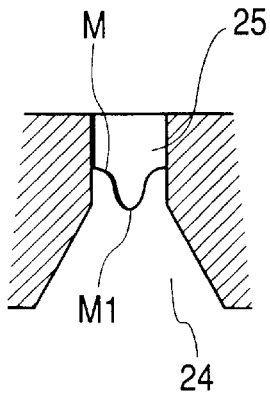

Further, when the inertance of ink in the nozzle orifice 3 is lowered, the response of the meniscus M to the pressure fluctuation of ink contained in the pressure chamber 23 is enhanced. Thus, as illustrated in FIG. 9C, the central portion M1 (that is, the locally concaved part) of the meniscus M is largely pulled thereinto in the second decompressed state caused in response to the second charging component P2. Thereafter, the ink column is strongly pushed in the ink ejecting direction owing to the reaction of the locally concaved part and to the compressing force caused in the response of the ejection component P4, similarly as in the aforementioned embodiment. Consequently, the jetting speed of the microdot ink droplet is increased as compared with that of the droplets in the related apparatus.

Similar effects are obtained by supplying the second decompressing component and then pulling a part of the meniscus M into the tapered space 24 in response thereto. In this case, for instance, a surface of the central portion M1, which is the locally concaved part, is pulled into the tapered space 24.

Meanwhile, the first embodiment sets the amount of ink of the satellite ink droplet in such a way as to be larger than the amount of ink of the main ink droplet thereby to make the impact positions of the main ink droplet and the satellite ink droplet coincide with each other and thereby to prevent the ink droplets from becoming mists. However, the invention is not limited to this embodiment. For example, the jetting speed of the satellite ink droplet may be set to be higher than the jetting speed of the main ink droplet. Hereinafter, a second embodiment constructed in such a manner is described.

The difference between the second embodiment and the first embodiment resides in the waveform of the microdot drive pulse. The rest of the constitute elements of the second embodiment is the same as the corresponding portion of the first embodiment. Thus, the description of such constituent elements is omitted herein.

Figure 10:
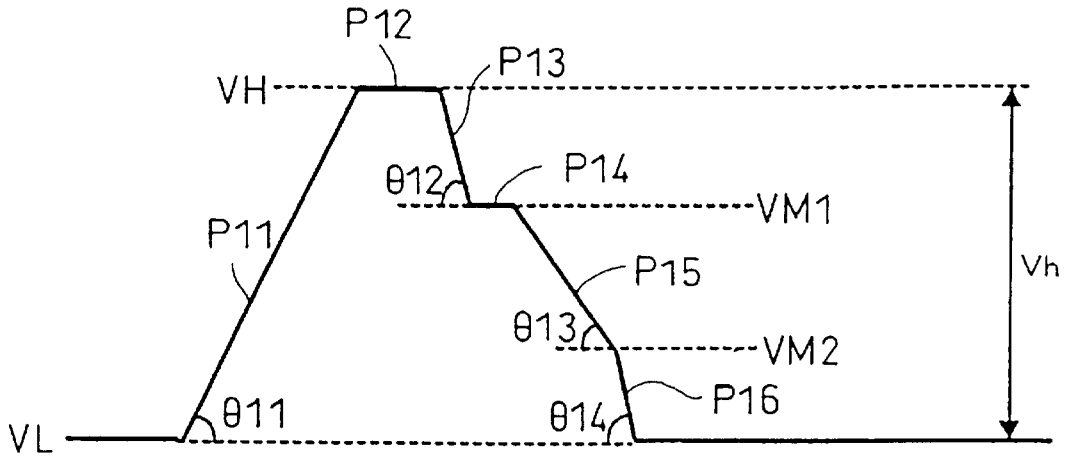
FIG. 10 is a view illustrating a microdot drive pulse according to a second embodiment of the invention.

The microdot drive pulse of the second embodiment has the shape of waveform illustrated in FIG. 10. When the recording head 2 is driven by using this microdot drive pulse DP2', the main ink droplet is separated from an end portion of the ink column and then jetted. Thereafter, a satellite ink droplet is separated from the remaining portion of the ink column and then jetted. Further, in the case of supplying this microdot drive pulse DP2', the compressing force for compressing the pressure chamber 23 is increased with the timing with which the satellite ink drop is torn off the ink column. Consequently, the jetting speed of the satellite ink droplet is set in such a way as to be higher than that of the main ink droplet.

That is, this microdot drive pulse DP2' is a signal constituted by consecutively and serially connecting a first charging component P11 serving as a first decompressing component, a first holding component P12 serving as a decompressed state holding component, a first discharging component P13 serving as a first compressing component, a second holding component P14 serving as a compressed state holding component, a second discharging component P15 serving as a second compressing component, and a third discharging component P16 serving as a third compressing component.

Figure 11A:
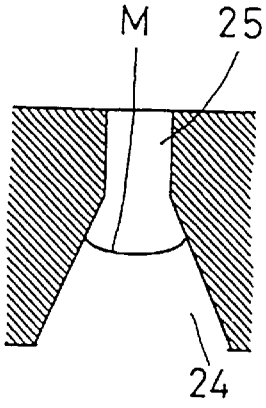
FIGS. 11A to 11C are views each illustrating a process of ejecting an ink droplet in the second embodiment.

The first charging component P11 raises the potential from the lowest potential (or reference potential) VL to the highest potential VH with a rising gradient θ11. When this first charging component P11 is supplied to the piezoelectric vibrator 31, the capacity of the pressure chamber 23 rapidly expands from the minimum capacity provided at the lowest potential VL to the intermediate capacity provided at the intermediate potential VM. With this expansion, the internal pressure of the pressure chamber 23 is rapidly decreased. The meniscus having been in the stationary state is pulled toward the pressure chamber 23 as shown in FIG. 11A. At that time, the central portion of the meniscus is largely pulled thereinto owing to the rapid decompression, as compared with the peripheral portions thereof.

The first holding component P12 is a component for maintaining the immediately precedent potential, that is, the highest potential VH over a predetermined time period. The pressure chamber 23 maintains the maximum capacity over the time period during which this first holding component P12 is supplied to the piezoelectric vibrator 31. In a time period in which this first holding component P12 is supplied, the central portion of the meniscus moves in the ink ejecting direction as a reaction. This central portion of the meniscus is brought into a condition in which the central portion swells upwardly from the peripheral portion.

The first discharging component P13 is a component for lowering the potential from the highest potential VH to a first discharge potential VM1 with a steeply lowering gradient θ12. When this first discharging component P13 is supplied to the piezoelectric vibrator 31, the capacity of the pressure chamber 23 is contracted from the maximum capacity provided by the highest potential VH to the capacity provided by the first discharge potential VM1. With this contraction, the pressure chamber 23 is compressed. Further, the central portion of the meniscus, which swells in the ink droplet ejecting direction, is further compressed. Thus, the central portion of the meniscus is extended like a column.

Figure 11B:
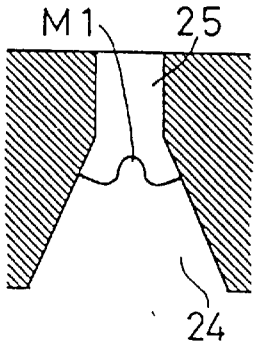

The second holding component P14 is a component for maintaining the first discharge potential VM1, which is the terminal potential of the first discharging component P13, over a predetermined time period. When this second holding component P14 is supplied to the piezoelectric vibrator 31, a contracting operation of the piezoelectric vibrator 31 in response to the first discharging component P13 is stopped. At that time, the central portion of the meniscus is extended like a thin column by the inertial force toward the ejecting direction as shown in FIG. 11B.

The second discharging component P15 is a component for lowering the potential from the first discharge potential VM1 to a second discharge potential VM2 with a constant lowering gradient θ13. When this second discharging component P15 is supplied to the piezoelectric vibrator 31, the capacity of the pressure chamber 23 contracts from a first intermediate capacity provided at the first discharge potential VM1 to a second intermediate capacity provided at the second discharge potential VM2. With this contraction, the ink contained in the pressure chamber 23 is compressed. Further, the timing, with which the second discharging component P15 is supplied, is synchronized with the timing with which a main ink droplet is separated from the ink column. Consequently, with the supply of the second discharging component P15, an end portion of the ink column is torn off. This torn-off portion is jetted as a main ink droplet.

Figure 11C:
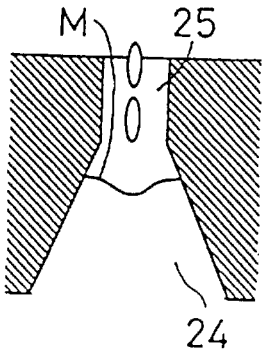

The third discharging component P16 is a component for lowering the potential from the second discharge potential VM2 to the lowest potential VL with a lowering gradient θ14 thereby to rapidly contract the pressure chamber 23. The lowering gradient θ14 corresponding to this third discharging component P16 is set in such a manner as to be steeper than the lowering gradient θ13 corresponding to the second discharging component P15. Thus, when the third discharging component P4 is supplied to the piezoelectric vibrator 31, the pressure chamber 23 contracts at the degree higher than that at which the chamber 23 contracts when the second discharging component P15 is supplied to the vibrator 31. Further, the timing, with which the third discharging component P16 is supplied, is synchronized with the timing with which a satellite ink droplet is separated from the ink column as shown in FIG. 11C. Therefore, the compressing force applied to the pressure chamber 23 with the timing, with which the satellite ink droplet is separated therefrom, is stronger than the compressing force applied to the pressure chamber 23 with the timing, with which the main ink droplet is separated therefrom. Thus, the jetting speed of the satellite ink droplet can be made to be higher than that of the main ink droplet.

Consequently, the impact positions of the main ink droplet and the satellite ink droplet can be made to coincide with each other. That is, because the speed of the satellite ink droplet ejected later than the main ink droplet is higher than that of the main ink droplet ejected earlier than the satellite ink droplet, the impact position of the main ink droplet can be made to be closer to the impact position of the satellite ink droplet, as compared with the difference in the impact positions therebetween in the case of the related apparatus.

Figure 12:
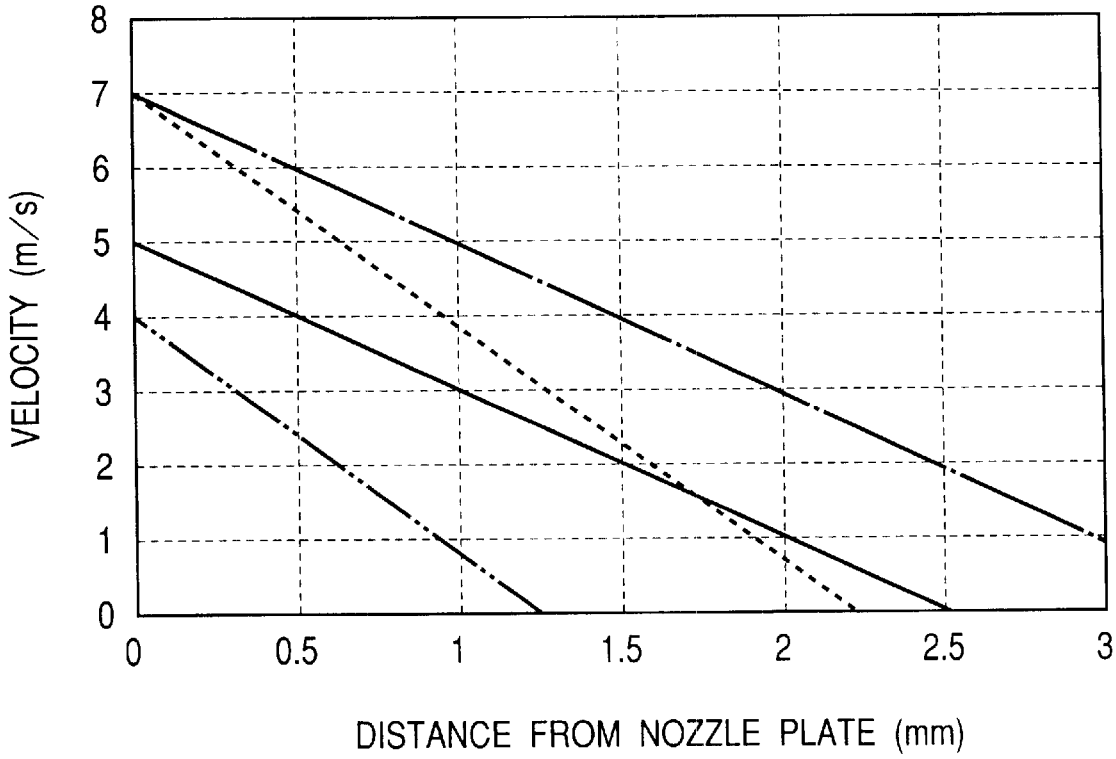
FIG. 12 is a graph showing the relation between the flight distance of an ink droplet from a nozzle plate and the jetting speed thereof in the second embodiment.

This is described in detail hereinbelow according to a practical example shown in FIG. 12, which is a graph showing the relation between the flight distance from the nozzle plate 19 and the jetting speed of an ink droplet. In this graph, a solid line indicates the data of a main ink droplet ejected in response to the microdot drive pulse DP2' of this embodiment. A dashed line indicates data of a satellite ink droplet ejected in response to the microdot drive pulse DP2' of this embodiment. A chain line indicates data of a main ink droplet ejected in response to the microdot drive pulse in the related apparatus. A double-dashed chain line indicates data of the satellite ink droplet ejected in response to the microdot drive pulse in the related apparatus. Here, the amounts of ink of the main ink droplets of this embodiment and the related apparatus are equal to each other and 1.0 pL. Moreover, the amounts of ink of the satellite ink droplets of this embodiment and the related apparatus are equal to each other and 0.5 pL.

First, such relation in the case of the main ink droplet ejected in this embodiment (corresponding to the solid line) is compared with that of the main ink droplet ejected in the related apparatus (corresponding to the one-dot chain line). The initial jetting speed in the case of the main ink droplet of the related apparatus is about 7.0 m/s. Further, as the flight distance increases, the jetting speed thereof decreases. The jetting speeds respectively corresponding to distances of 1.0 mm, 2.0 mm, and 3.0 mm are about 5.0 m/s, 3.0 m/s. and 1.0 m/s. On the other hand, the initial jetting speed in the case of the main ink droplet according to this embodiment is about 5.0 m/s. Further, as the flight distance increases, the jetting speed thereof decreases. The jetting speeds thereof respectively corresponding to distances of 1.0 mm, 2.0 mm, and 2.5 mm are about 3.0 m/s, 1.0 m/s and 0 m/s.

Next, such relation in the case of the satellite ink droplet ejected in this embodiment (corresponding to the dashed line) is compared with that of the satellite ink droplet ejected in the related apparatus (corresponding to the two-dot chain line). The initial jetting speed of the satellite ink droplet in the case of the related apparatus is about 4.0 m/s and thus lower than that of the main ink droplet in such a case. Further, the amount of ink thereof is extremely small (0.5 pL), so that the rate of reduction in the ratio of the jetting speed to the flight distance is relatively high. Therefore, at a distance of 1.0 mm, the speed is reduced to about 0.7 m/s. Furthermore, the speed becomes about 0 m/s. On the other hand, the initial jetting speed of the satellite ink droplet according to this embodiment is about 7.0 m/s, which is sufficiently high in comparison with the speed of the main ink droplet in this embodiment. Therefore, even when the amount of ink is extremely small, the satellite ink droplet according to this embodiment can be jetted a relatively long way off. That is, the jetting speeds respectively corresponding to distances of 1.0 mm, 2.0 mm and 2.2 mm are about 3.8 m/s, 0.7 m/s and 0 m/s.

Here, when the distance from the nozzle plate 19 to the recording paper 10 is 1.0 mm, the jetting speed of the main ink droplet in the related apparatus is about 5.0 m/s at the impact position, while the speed of the satellite ink droplet in such a case is about 0.7 m/s. Thus, it takes relatively long time until the satellite ink droplet impacts since the main ink droplet impacts. Therefore, the difference in the impact position between both of these ink droplets increases. On the other hand, in this embodiment, the speed of the main ink droplet at the impact position is about 3.0 m/s, and the speed of the satellite ink droplet is about 3.8 m/s. Therefore, the speed of the satellite ink droplet is higher than that of the main ink droplet in this embodiment. Thus, the main ink droplet and the satellite ink droplet successively impact on the recording paper, so that the difference in the impact position therebetween is reduced.

Further, when the distance from the nozzle plate 19 to the recording paper 10 is 1.5 mm, there is probability that the ink droplets become mists in the related apparatus and floats in the air. In contrast, in this embodiment, the speed of the main ink droplet at the impact position is about 2.0 m/s, and the speed of the satellite ink droplet at the impact position is about 2.2 m/s. Consequently, the ink droplets are enabled to reliably impact on the recording paper 10.

As described above, in the case of supplying the microdot drive pulse DP2' according to this embodiment, the difference in potential among the components and the time period during which each of the components (thus, the shape of the waveform of each of the components) are set so that the jetting speed of the satellite ink droplet is higher than the jetting speed of the main ink droplet. Thus, even when microdot ink droplets are ejected, the impact positions of the main ink droplet and the satellite ink droplet can be made to coincide with each other. Thus, the image quality is improved.

Here, various constituent elements may be added to and altered in the aforementioned embodiment according to the appended claims. For instance, although a control operation of setting the amount of ink of the satellite ink droplet in such a manner as to be larger than the amount of ink of the main ink droplet (in the first embodiment) and another control operation of setting the jetting speed of the satellite ink droplet in such a way as to be higher than the jetting speed of the main ink droplet (in the second embodiment) have been exemplified in the foregoing description of the embodiments, both of these control operations may be combined with each other. That is, the apparatus may be controlled by changing the shape of the waveform of the microdot drive pulse so that the amount of ink of the satellite ink droplet is larger than the amount of ink of the main ink droplet, and that the jetting speed of the satellite ink droplet is higher than the jetting speed of the main ink droplet.

Such a control operation can be achieved by suitably setting the difference in potential between the second discharging component P15 and the third discharging component P16 of the microdot drive pulse DP2' and the time periods, during which the components are supplied, and the gradients respectively corresponding to the components. Alternatively, such a control operation can be achieved by using a microdot drive pulse constituted by the first charging component P1, the second charging component P2, the first holding component P3, the first discharging component P4, the second holding component P14, the second discharging component P15, and the third discharging component P16.

Moreover, although it has been described in the foregoing description of the embodiments that a microdot ink droplet is constituted by a single main ink droplet and a single satellite ink droplet, the invention may be applied to a driving method adapted so that the ejected microdot ink droplet includes a plurality of satellite ink droplets. For example, the invention may be applied to the case that the satellite ink droplet is divided into a plurality of droplets, that is, secondary satellite ink droplets are generated therefrom. In this case, effects similar to those of the embodiments are obtained when the amount of ink of at least one of a plurality of satellite ink droplets of the microdot ink droplet is larger than the amount of ink of the main ink droplet. Similarly, when the jetting speed of at least one of the satellite ink droplets is higher than that of the main ink droplet, effects similar to those of the embodiments are obtained.

Furthermore, although the piezoelectric vibrators 31 of the type adapted to be contracted by charging so as to expand the pressure chamber 23, whereas to be extended by discharging so as to contract the pressure chamber 23 to eject an ink drop, have been exemplified in the foregoing description of the embodiments, the piezoelectric vibrator of the invention is not limited to the vibrator of such a type. The recording apparatus of the invention may be similarly constituted by using piezoelectric vibrators 31 of the type each adapted to be contracted by discharging so as to expand the pressure chamber 23, whereas to be extended by charging so as to contract the pressure chamber 23 to eject an ink drop. Alternatively, the apparatus of the invention may be constituted by using piezoelectric vibrators 31 of the type enabled to change the capacity of the pressure chamber 23 by performing bending deformation.

Furthermore, the pressure generating element for varying the capacity of the pressure chamber 23 is not limited to the piezoelectric vibrator 31. In short, as long as a pressure generating element is enabled to cause the pressure fluctuation of ink contained in the pressure chamber 23, the invention can be applied to the apparatus using such pressure generating elements. For example, the invention can be applied to a recording head using a magnetostrictive element that is a kind of an electromechanical tranducer.

What is claimed is:

1. A method of driving an ink jet recording head provided with a pressure chamber communicated with a nozzle orifice from which a main ink droplet and a satellite ink droplet accompanied with the main ink droplet are ejected to form an ink dot on a recording medium, comprising the steps of:

generating one cycle of pressure fluctuation in the pressure chamber;

ejecting ink contained therein from the nozzle orifice as the main ink droplet having a first volume, due to the pressure fluctuation; and ejecting ink contained therein from the nozzle orifice as the satellite ink droplet having a second volume which is larger than the first volume, due to the one cycle of pressure fluctuation, wherein the pressure fluctuation generating step includes the steps of:

decompressing the pressure chamber such that a central portion of a meniscus of ink in the nozzle orifice is locally pulled toward the pressure chamber; and compressing the pressure chamber when the pulled meniscus reactionally moves in a direction in which the ink droplets are ejected.

2. The driving method as set forth in claim 1, wherein the decompressing step includes the steps of:

decompressing the pressure chamber with a first decompressing force so as to pull the meniscus toward the pressure chamber while keeping a shape of the meniscus in a stationary state thereof;

decompressing the pressure chamber with a second decompressing force which is greater than the first decompressing force, so as to locally pull the central portion of the meniscus; and holding the decompressed state of the pressure chamber until the pulled meniscus reactionally moves in the direction in which the ink droplets are ejected.

3. A method of driving an ink jet recording head provided with a pressure chamber communicated with a nozzle orifice from which a main ink droplet and a satellite ink droplet accompanied with the main ink droplet are ejected to form an ink dot on a recording medium, comprising the steps of:

generating pressure fluctuation in the pressure chamber;

ejecting ink contained therein from the nozzle orifice as the main ink droplet with a first speed, due to the pressure fluctuation; and ejecting ink contained therein from the nozzle orifice as the satellite ink droplet with a second speed which is faster than the first speed, due to the pressure fluctuation, wherein the pressure fluctuation generating step includes the steps of:

compressing the pressure chamber with a first compressing force at a timing when the main ink droplet is separated from a meniscus of ink in the nozzle orifice; and compressing the pressure chamber with a second compressing force which is greater than the first compressing force, at a timing when the satellite ink droplet is separated from the meniscus; and the compressing step with the first compressing force and the compressing step with the second compressing force are continuously performed.

4. An ink jet recording apparatus, comprising:

a recording head, provided with a pressure chamber communicated with a nozzle orifice;

a pressure generating element, which generates pressure fluctuation in ink contained in the pressure chamber; and a drive signal generator, which generates a drive signal for driving the pressure generating element such that a main ink droplet and a satellite ink droplet accompanied with the main ink droplet are ejected due to one cycle of pressure fluctuation, to form an ink dot on a recording medium, the main ink droplet having a first volume, and the satellite ink droplet having a second volume which is larger than the first volume, wherein the drive signal includes:

a decompressing component, which decompresses the pressure chamber such that a central portion of a meniscus of ink in the nozzle orifice is locally pulled toward the pressure chamber; and a compressing component, which compresses the pressure chamber when the pulled meniscus reactionally moves in a direction in which the ink droplets are ejected.

5. The recording apparatus as set forth in claim 4, wherein the decompressing component includes:

a first decompressing component, which decompresses the pressure chamber with a first decompressing force so as to pull the meniscus toward the pressure chamber while keeping a shape of the meniscus in a stationary state thereof; and a second decompressing component, which decompresses the pressure chamber with a second decompressing force which is greater than the first decompressing force, so as to locally pull the central portion of the meniscus.

6. The recording apparatus as set forth in claim 5, wherein:

the nozzle orifice has a first part in which a diameter thereof is constant, and a second part in which the diameter is enlarged toward the pressure chamber; and the central portion of meniscus pulled by the second decompressing component is placed in the second part of the nozzle orifice.

7. The recording apparatus as set forth in claim 5, wherein a termination end of the second decompressing component and an initial end of the compressing component are connected by a first holding component which maintains a potential of the termination end of the second decompressing component.

8. The recording apparatus as set forth in claim 5, wherein the drive signal includes a damping component which follows the compressing component and compresses the pressure chamber so as to prevent the meniscus after the ink droplet ejection from reactionally moving toward the pressure chamber.

9. The recording apparatus as set forth in claim 8, wherein a termination end of the compressing component and an initial end of the damping component are connected by a second holding component which maintains a potential of the termination end of the compressing component.

10. The recording apparatus as set forth in claim 4, wherein the pressure generating element is an electromechanical transducer.

11. The recording apparatus as set forth in claim 10, wherein the electromechanical transducer is a piezoelectric vibrator.

12. An ink jet recording apparatus, comprising:

a recording head, provided with a pressure chamber communicated with a nozzle orifice;

a pressure generating element, which generates pressure fluctuation in ink contained in the pressure chamber; and a drive signal generator, which generates a drive signal for driving the pressure generating element such that a main ink droplet and a satellite ink droplet accompanied with the main ink droplet are ejected to form an ink dot on a recording medium, the main ink droplet ejected with a first speed, and the satellite ink droplet ejected a second speed which is faster than the first speed, wherein:

the drive signal includes:

a first compressing component, which compresses the pressure chamber with a first compressing force at a timing when the main ink droplet is separated from a meniscus of ink in the nozzle orifice; and a second compressing component, which compresses the pressure chamber with a second compressing force which is greater than the first compressing force, at a timing when the satellite ink droplet is separated from the meniscus; and a termination end of the first compressing component and an initial end of the second compressing component are connected.

13. The recording apparatus as set forth in claim 12, wherein a potential gradient of the second compressing component is steeper than a potential gradient of the first compressing component.

14. The recording apparatus as set forth in claim 12, wherein the pressure generating element is an electromechanical transducer.

15. The recording apparatus as set forth in claim 14, wherein the electromechanical transducer is a piezoelectric vibrator.

16. A method of driving an ink jet recording head provided with a pressure chamber communicated with a nozzle orifice from which a main ink droplet and a satellite ink droplet accompanied with the main ink droplet are ejected to form an ink dot on a recording medium, comprising the steps of:

decompressing the pressure chamber while lowering an inertance of ink situated closer to the pressure chamber than an inertance of ink situated closer to the nozzle orifice; and compressing the pressure chamber to eject the main ink droplet and the satellite ink droplet.

17. The driving method as set forth in claim 16, wherein a shape of the nozzle orifice is determined so as to realize the inertance lowering.

18. The driving method as set forth in claim 16, wherein an intensity and a duration time period of a decompressing force generated in the decompressing step is determined so as to realize the inertance lowering.

19. The driving method as set forth in claim 16, wherein the main ink droplet and the satellite ink droplet are ejected during a period between a first instance when the pressure chamber is fully compressed and a next subsequent instance when the pressure chamber is fully compressed, wherein the pressure chamber is decompressed between the first instance and the next subsequent instance.

20. The driving method as set forth in claim 16, wherein the main ink droplet and the satellite ink droplet are ejected during a period between a first instance when the pressure chamber is fully decompressed and a next subsequent instance when the pressure chamber is fully decompressed.

21. The driving method as set forth in claim 16, wherein the decompressing step is performed such that a peripheral portion of a meniscus is situated in a first section of the nozzle orifice having a first diameter and a center part of the meniscus is situated in a second section of the nozzle orifice having a second diameter larger than the first diameter.

22. The driving method as set forth in claim 16, wherein the main ink droplet and the satellite ink droplet are ejected by one cycle of the decompressing step and the compressing step.

23. A method of driving an ink jet recording head provided with a pressure chamber communicated with a nozzle orifice from which a main ink droplet and a satellite ink droplet accompanied with the main ink droplet are ejected to form an ink dot on a recording medium, comprising:

decompressing the pressure chamber while lowering an inertance of ink situated closer to the pressure chamber than an inertance of ink situated closer to the nozzle orifice; and compressing the pressure chamber to eject the main ink droplet and the satellite ink droplet, wherein the main ink droplet and the satellite ink droplet are ejected during a period between a first instance when the pressure chamber is fully compressed and a next subsequent instance when the pressure chamber is fully compressed, wherein the pressure chamber is decompressed between the first instance and the next subsequent instance.

24. A method of driving an ink jet recording head provided with a pressure chamber communicated with a nozzle orifice from which a main ink droplet and a satellite ink droplet accompanied with the main ink droplet are ejected to form an ink dot on a recording medium, comprising:

decompressing the pressure chamber while lowering an inertance of ink situated closer to the pressure chamber than an inertance of ink situated closer to the nozzle orifice; and compressing the pressure chamber to eject the main ink droplet and the satellite ink droplet, wherein the main ink droplet and the satellite ink droplet are ejected during a period between a first instance when the pressure chamber is fully decompressed and a next subsequent instance when the pressure chamber is fully decompressed.

* * * * *